US006224184B1

(12) United States Patent
Imanaka et al.

(10) Patent No.: US 6,224,184 B1
(45) Date of Patent: May 1, 2001

(54) PRINTHEAD COMPATIBLE WITH VARIOUS PRINTERS AND INK-JET PRINTER USING THE PRINTHEAD

(75) Inventors: Yoshiyuki Imanaka, Kawasaki; Masahiko Ogawa, Hino; Ichiro Saito; Teruo Ozaki, both of Yokohama; Toshimori Miyakoshi, Kawasaki; Muga Mochizuki, Yokohama, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 08/883,573

(22) Filed: Jun. 26, 1997

(30) Foreign Application Priority Data

Jul. 1, 1996 (JP) ..... 8-171346
Oct. 29, 1996 (JP) ..... 8-286477

(51) Int. Cl.[7] ..... B41J 29/393
(52) U.S. Cl. ..... 347/19
(58) Field of Search ..... 347/19, 17, 23, 347/15, 12, 13, 14, 40, 42, 41, 50, 49, 86, 43; 400/120

(56) References Cited

U.S. PATENT DOCUMENTS

| | | | |
|---|---|---|---|
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/140 R |
| 4,723,129 | 2/1988 | Endo et al. | 346/1.1 |
| 4,740,796 | 4/1988 | Endo et al. | 346/1.1 |
| 4,741,634 * | 5/1988 | Nozaki et al. | 400/120 |
| 5,479,197 | 12/1995 | Fujikawa et al. | 347/63 |
| 5,580,468 | 12/1996 | Fujikawa et al. | 216/27 |
| 5,594,478 * | 1/1997 | Matsubara et al. | 347/15 |
| 5,625,384 * | 4/1997 | Numata et al. | 347/23 |

FOREIGN PATENT DOCUMENTS

| | | |
|---|---|---|
| 0274435 | 7/1988 | (EP) . |
| 0315417 | 5/1989 | (EP) . |
| 0626266 | 11/1994 | (EP) . |
| 0647530 | 4/1995 | (EP) . |
| 2843064 | 4/1979 | (JP) . |
| 54-51837 | 4/1979 | (JP) . |

* cited by examiner

*Primary Examiner*—John Barlow
*Assistant Examiner*—Charles W. Stewart, Jr.
(74) *Attorney, Agent, or Firm*—Fitzpatrick, Cella, Harper & Scinto

(57) ABSTRACT

A printhead compatible with various printers, e.g. a printer having low print density or a printer having high print density, enables printing in the best capability of the printer. The printhead comprises: a determination circuit 24 which determines a type of a printer incorporating the printhead, and switches SW1 and SW2 which select a method of driving the printhead according to in the printer, on the basis of the determination result by the determination circuit 24. When the printhead is installed in the printer capable of printing at 360 dpi, four print dots printed at 720 dpi substantially express one dot printed at 360 dpi. Meanwhile, when the printhead is installed in the printer capable of printing at 720 dpi, one print dot expresses one dot printed at 720 dpi.

39 Claims, 15 Drawing Sheets

PRINTHEAD COMPATIBLE WITH VARIOUS PRINTERS AND INK-JET PRINTER USING THE PRINTHEAD

BACKGROUND OF THE INVENTION

The present invention relates to a printhead and an ink-jet printer (recording apparatus) using the printhead, and more particularly to a printhead (recording head) compatible with various printers and an ink-jet printer utilizing the removable printhead.

Printheads have conventionally been exchangeable in an ink-jet printer. The ink-jet printer where a plurality of printheads are exchangeable, comprises a determining terminal or a determining unit in the printhead to enable the apparatus to determine the type of the printhead, so that the apparatus can determine the type of the printhead which has just been installed.

Currently, great interests have been brought to the ink-jet printing method since it provides various advantages, for instance, noise generated at the time of printing is so little that it can be disregarded; high-speed printing is possible; a regular sheet of paper can be utilized; particular processing such as fixing of printing material is unnecessary; and so on.

More specifically, the ink-jet printing method disclosed in Japanese Patent Application Laid-Open No. 54-51837 and German Publication (DOLS: Deutschland Offenlegungsschrift) No. 2843064, has a different feature from those of other ink-jet printing methods in the way that it provides heat energy to ink liquid to generate driving force for ink discharge.

Furthermore, according to the printing method disclosed in the above-mentioned patent publications, the liquid activated by heat energy changes its state due to rapid increase in volume. Driving force generated by the change in the state causes discharging of the liquid from an orifice provided at the end of a printhead, forming a discharging droplet, and the droplet adheres to a print medium to form a pixel, thereby executing printing.

The printing method disclosed in DOLS No. 2843064 is not only effectively applied to so-called drop-on-demand printing, but also readily realizes printing performed by a full-line type printhead having multiple orifices integrated in high density, where the print width of the printhead is as large as the width of the print medium. Therefore, the printing method provides advantages in that an image having high resolution and high quality can be obtained at high speed.

The printhead adopting aforementioned printing method is configured with: an orifice provided to discharge liquid, a nozzle connected to the orifice and including a liquid channel having a heating unit as a part of its structure to generate heat energy to act on the liquid and discharge a droplet, and a substrate integrating an electrothermal transducer (heater) serving as means for generating heat energy.

Lately, such substrate of a printhead not only integrates a plurality of heaters, but also integrates drivers which drive each of the heaters, shift registers which can store image signals having the number of bits equal to the number of heaters to parallelly transfer these serially-inputted image signals to respective drivers, and a logical circuit such as a latch circuit or the like which temporarily stores data outputted by the shift registers.

FIG. 14 is a block diagram showing configuration of a logical circuit of a printhead having 32 heaters (printing elements), which is capable of printing at the conventional density, 360 dpi.

Referring to FIG. 14, reference numeral 400 denotes a substrate; 401, heaters (H1–H32); 402, power transistors; 403, a 32-bit latch circuit; and 404, a 32-bit shift register. Reference numeral 415 denotes a sensor which monitors resistance values of the heaters 401 and temperature of the substrate 400, and also denotes a heater for keeping the substrate 400 warm. A plurality of such sensors and heaters may be provided. Reference numerals 405 to 414-*n* respectively denote input/output pads. Reference numeral 405 denotes a clock input pad for inputting a clock signal (CLK) to drive the shift register 404; 406, an image data input pad for serially inputting image data (DATA); 407, a latch input pad for inputting a latch clock signal (LTCLK) in order to latch image data in the latch circuit 403; 408, a driving signal input pad for inputting a heat pulse (HEAT) in order to externally control driving timing by turning on the power transistor 402 and sending an electric current to the heaters 401; 409, a driving power input pad for supplying driving power (3V–8V, generally 5V) for the logical circuit; 410, a GND terminal; 411, a heater's power input pad for supplying power to the heaters 401; and 412, a reset input pad for inputting a reset signal (RST) to initialize the latch 403 and shift register 404.

In addition, reference numerals 413-1 to 413-8 denote block-selecting-signal input pads for inputting block-selecting signals (BLK1–BLK8) which select a block at the time of the time-divisional drive control where the 32 heaters 401 are divided into eight blocks to be driven. Reference numerals 414-1 to 414-*n* denote output pads of monitor signals and input pads of control signals for controlling driving of sensors and driving of heaters provided to maintain internal temperature of a printhead.

Next, description will be provided on a driving sequence of a printhead having the above-described configuration. Herein, image data (DATA) is assumed to be binary data where one pixel is expressed by one bit.

When the main unit of a printer, incorporating the printhead, serially outputs image data (DATA) in synchronization with a clock signal (CLK), the data is inputted by the shift register 404. The inputted image data (DATA) is temporarily stored in the latch circuit 403, which then outputs ON/OFF signal in correspondence with a value ("0" or "1") of the image data.

Herein, when a block is selected by a block-selecting signal (BLK1–BLK8), if a heat pulse (HEAT) is inputted while an output of the latch circuit 403 is "ON," the corresponding power transistor 402 is driven for the length of time the heat pulse (HEAT) is "ON." Accordingly, current is supplied to the corresponding heaters 401 to heat ink whereby discharging ink droplets.

FIG. 15 is a timing chart showing the driving timing in a case where 32 heaters (H1, H2, . . . H32) are provided, and are divided into eight blocks (each block having four heaters H1–H4, H5–H8, . . . , H29–H32) to be driven by time-divisional drive control by the block-selecting signals (BLK1–BLK8). The waveform illustrated in FIG. 15 only shows, among the signals transmitted from the printer' main unit, the block-selecting signals for time-divisional drive control and the heat pulse (HEAT) for deciding a length of time to drive the heater 401.

When the output of the latch circuit 403 is "ON," all the heaters, being divided into blocks, are driven once in one print cycle at slightly different timings by the control signals. On account of such time-divisional drive control, the number of heaters to be driven simultaneously is reduced, the capacity of the power source is reduced, and noise generated at the time of driving is reduced.

As the printer and printhead are further diversified and developed in the future to meet various needs, such as low price, capability to express a complicated image having high quality and high resolution and so on, it is necessary that various printers can use various types of printheads, instead of utilizing a dedicated printhead for each printer. To cope with the diversification of printheads, efforts have been made to standardize connecting portions among the printers and printheads. Nevertheless, the printer was merely able to distinguish the type of printhead that is being installed.

Moreover, reflecting upon the recent tendency to prefer high-quality image printing, the main subject of development and manufacturing of the printhead is now turning into print density of 600/720 dpi from the conventional density 300/360 dpi. Therefore, the latest printhead requires new configuration for a substrate which is different from that of the aforementioned conventional printhead, in terms of arraying pitch of heaters (printing elements), drivers, logical circuits or the like.

On the other hand, as long as printheads are used as consumables, a manufacturer must keep producing printheads having conventional print density which was produced and sold in the past, even if a printer incorporating the conventional printhead is no longer manufactured. Therefore, the types of printheads manufacturers must produce rapidly increase.

The above-described tendency is quite inefficient in terms of production efficiency of printheads, resulting in increase in manufacturing cost. In addition, when a user purchases a printhead to replace an old printhead, the user tends to have difficulties determining which type of printhead to purchase.

SUMMARY OF THE INVENTION

The present invention has been made in consideration of the above situation, and has as its object to provide a printhead which can be used in various printers.

According to this aspect of the present invention, the foregoing object is attained by providing a printhead for performing printing by discharging ink, comprising: determine means for determining a type of a printer incorporating the printhead; and select means for selecting a driving method according to the printer, on the basis of the determination result of the determine means.

In accordance with the aspect of the present invention as described above, a type of a printer in which the printhead is installed is determined, and in accordance with the determination, a driving method according to the printer is selected.

It is another object of the present invention to provide a printer which outputs signals to determination means of the above-described printhead.

It is still another object of the present invention to provide a printhead cartridge comprising the above-described printhead and an ink tank which contains ink to be supplied to the printhead.

It is still another object of the present invention to provide a method of printing performed by utilizing the above-described printhead.

It is still another object of the present invention to provide a printhead which is compatible with the conventional-type printer having low print density, or with a new-type printer having a high print density, and which can perform printing in a print density conformable to a printer in which the printhead is installed; and a printer using the aforementioned printhead.

According to this aspect of the present invention, the foregoing object is attained by providing a printhead compatible with plural types of printers whose print resolution are different, comprising: determine means for determining which type of the printers is used; and drive control means for controlling drivers, on the basis of the determination result of the determine means, such that printing is performed in accordance with a print resolution of the printer incorporating the printhead.

More specifically, the printhead may contain N (positive integer) printing elements; N driving circuits for supplying power and driving the N printing elements; M (positive integer) latch circuits for latching N/M bits of image data; a shift register for storing the N/M bits of image data; L (positive integer) block-selecting-signal input terminals for inputting L block-selecting signals so as to divide the N printing elements into L blocks and drive the L blocks respectively; a print-density-selecting signal terminal for inputting a print-density selecting signal which selectively instructs printing in a first print density or in a second print density, which is M times as the first print density; and a control circuit for controlling latch operation for the M latch circuits in accordance with the print-density selecting signal, wherein each of the N driving circuits is driven for M times in one cycle of the L block-selecting signals.

Further, according to the present invention, the foregoing object is attained by providing a printer using the aforementioned printhead, comprising: transmit means for transmitting the print-density selecting signal to the print-density-selecting signal terminal; transfer means for transferring image data in a unit of N/M bits to the shift register for M times; and latch control means for controlling the latch operation such that a latch signal is transferred each time the transfer means transfers the N/M bits of image data, and that transfer operation for M times realizes latching of the N bits of image data in the M latch circuits.

In accordance with the aspect of the present invention as described above, for instance, in a case where a printhead is incorporated in a printer capable of printing in the first print density which is a low density, the same data is latched in M latch circuits. When L block-selecting signals are sequentially inputted, N driving circuits are driven for M times in the input cycle of the block-selecting signals to perform printing.

In accordance with the foregoing printing, a plurality of print dots having the second print density, which is higher than the first print density, substantially express a single print dot having the first print density.

Meanwhile, in a case where the printhead is incorporated in a printer capable of printing in the L second print density which is a high density, image data is transferred and inputted to the shift registers in the unit of N/M bits. A latch signal is inputted each time N/M-bit image data is inputted. Upon M times of transferring, the total of N bits of image data is latched in the M latch circuits.

The invention is particularly advantageous since one printhead can be used in various printers e.g., from an inexpensive type having a simple function to an expensive high-performance type, or from an economical type to a high-quality and high-resolution type.

Furthermore, an internal unit of the printhead distinguishes even the economical type of a printer and automatically selects a driving method of the apparatus. Therefore, the printhead can be used without providing the printer with any special interface.

According to another aspect of the present invention, image data is transferred and inputted to the shift registers in the unit of N/M bits. A latch signal is inputted each time N/M bits of image data is inputted. Upon M times of transferring, N bits of image data in total is latched in M latch circuits. Therefore, a single printhead can be used for any one of a printer having low print density and a printer having high density.

By virtue of the above, there is an advantage from a manufacturer's standpoint in that manufacturers does not need to increase types of printheads to be manufactured in order to conform with each print density. Accordingly, this contributes to manufacturing a large quantity of printheads of the same kind, resulting in reduction of manufacturing cost.

In addition, there is an advantage from a user's point of view in that a user no longer has difficulties in selecting a type of printhead from many types of printheads.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention, and together with the description, serve to explain the principles of the invention.

DETAILED DESCRIPTION OF THE PREFERRED EMBODIMENTS

Preferred embodiments of the present invention will be described in detail in accordance with the accompanying drawings.

Brief Description of Apparatus Main Unit

Figure 1:
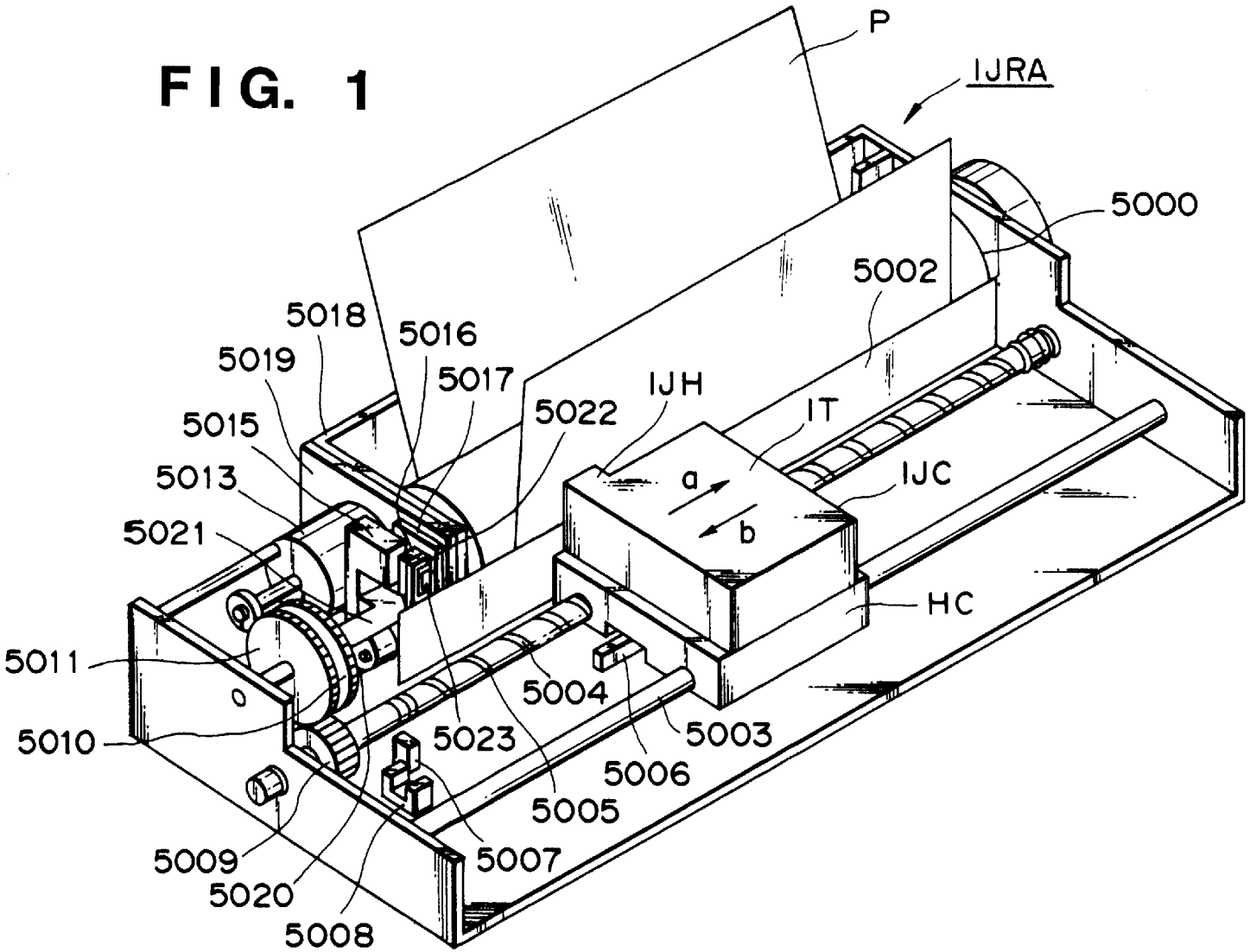
FIG. 1 is a perspective view showing the outer appearance of a printer as a typical embodiment of the present invention, which performs printing by ink-jet printing method.

FIG. 1 is a perspective view showing the outer appearance of an ink-jet printer (ink-jet recording apparatus) IJRA as a typical embodiment of the present invention. It is assumed-herein that the printer IJRA is capable of printing at print density of 720 dpi. Referring to FIG. 1, a carriage HC engages with a spiral groove 5004 of a lead screw 5005, which rotates via driving force transmission gears 5009 to 5011 upon forward/reverse rotation of a driving motor 5013. The carriage HC has a pin (not shown), and is reciprocally scanned in the directions of arrows a and b while being supported by a guide rail 5003. An integrated ink-jet cartridge IJC, incorporating a printing head (ink-jet recording head) IJH and an ink tank IT, is mounted on the carriage HC. Reference numeral 5002 denotes a sheet pressing plate, which presses a paper sheet P against a platen 5000, ranging from one end to the other end of the scanning path of the carriage HC. Reference numerals 5007 and 5008 denote photocouplers which serve as a home position detector for recognizing the presence of a lever 5006 of the carriage in a corresponding region, and are used for switching, e.g., the rotating direction of the motor 5013. Reference numeral 5016 denotes a member for supporting a cap member 5022, which caps the front surface of the printing head IJH; and 5015, a suction device for sucking ink residue through the interior of the cap member. The suction device 5015 performs suction recovery of the printing head via an opening 5023 of the cap member 5015. Reference numeral 5017 denotes a cleaning blade; 5019, a member which allows the blade to be movable in the back-and-forth direction of the blade. These members are supported on a main unit support plate 5018. The shape of the blade is not limited to this, but a known cleaning blade can be used in this embodiment. Reference numeral 5021 denotes a lever for initiating a suction operation in the suction recovery operation. The lever 5021 moves upon movement of a cam 5020, which engages with the carriage, and receives a driving force from the driving motor via a known transmission mechanism such as clutch switching.

The capping, cleaning, and suction recovery operations are performed at their corresponding positions upon operation of the lead screw 5005 when the carriage reaches the home-position side region. However, the present invention is not limited to this arrangement as long as desired operations are performed at known timings.

An ink-jet printer IJRA having the above-described configuration includes a print sheet automatic feeder (not shown) for automatically feeding a print sheet P.

Note that the ink-jet cartridge IJC does not need to be the type that integrally incorporates the printhead IJH and ink tank IT, but may be a separable type.

Figure 2:
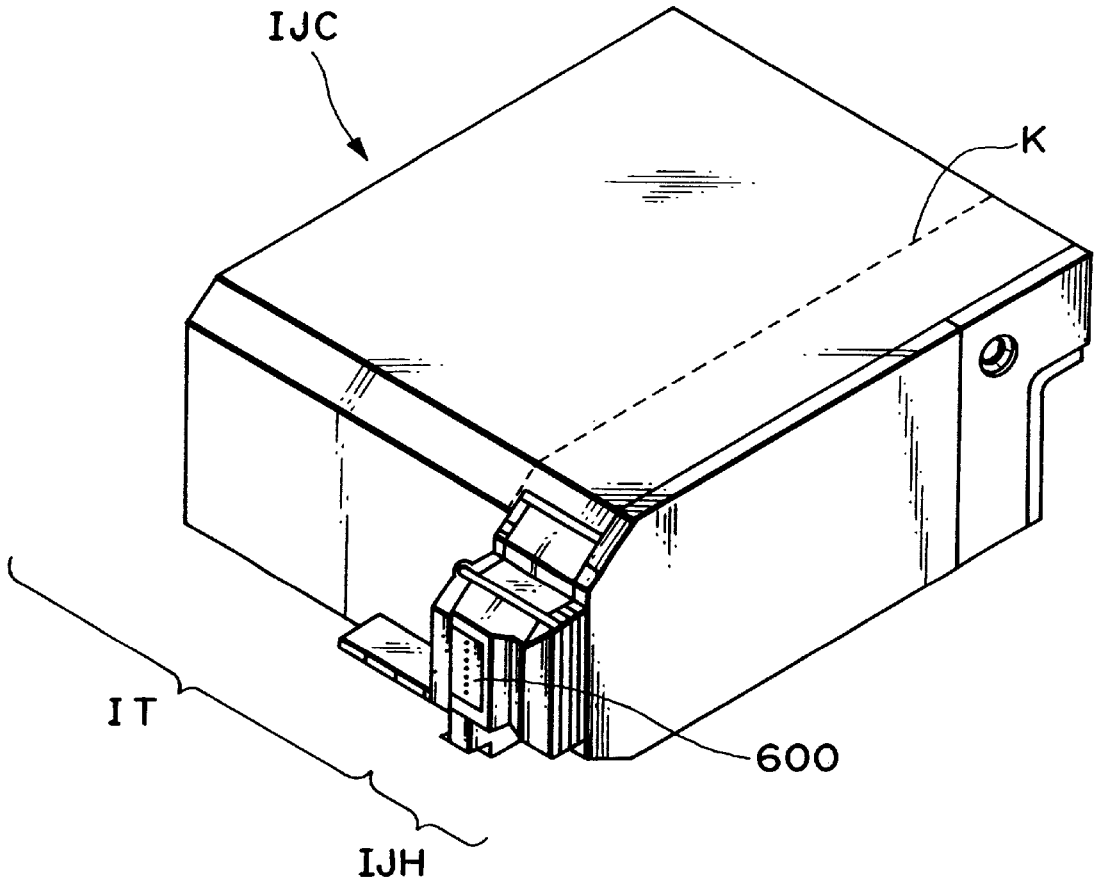
FIG. 2 is a perspective view showing the outer appearance of an ink-jet cartridge IJC where an ink tank and printhead are separable.

FIG. 2 is a perspective view showing the outer appearance of the ink-jet cartridge IJC where the printhead IJH and ink tank IT are separable.

In the ink-jet cartridge IJC shown in FIG. 2, the printhead IJH having a plurality of discharge orifices 600 can be separated at the boundary line K from the ink tank IT containing ink to be supplied to the printhead IJH. The ink-jet cartridge IJC includes an electrical contact portion so that the ink-jet cartridge IJC receives electrical signals from the carriage HC when mounted on the carriage HC. The printhead IJH is driven by the received electrical signals. The ink tank IT includes a fibrous or porous ink absorbing member for maintaining ink.

Description of Control Circuit

Figure 3:
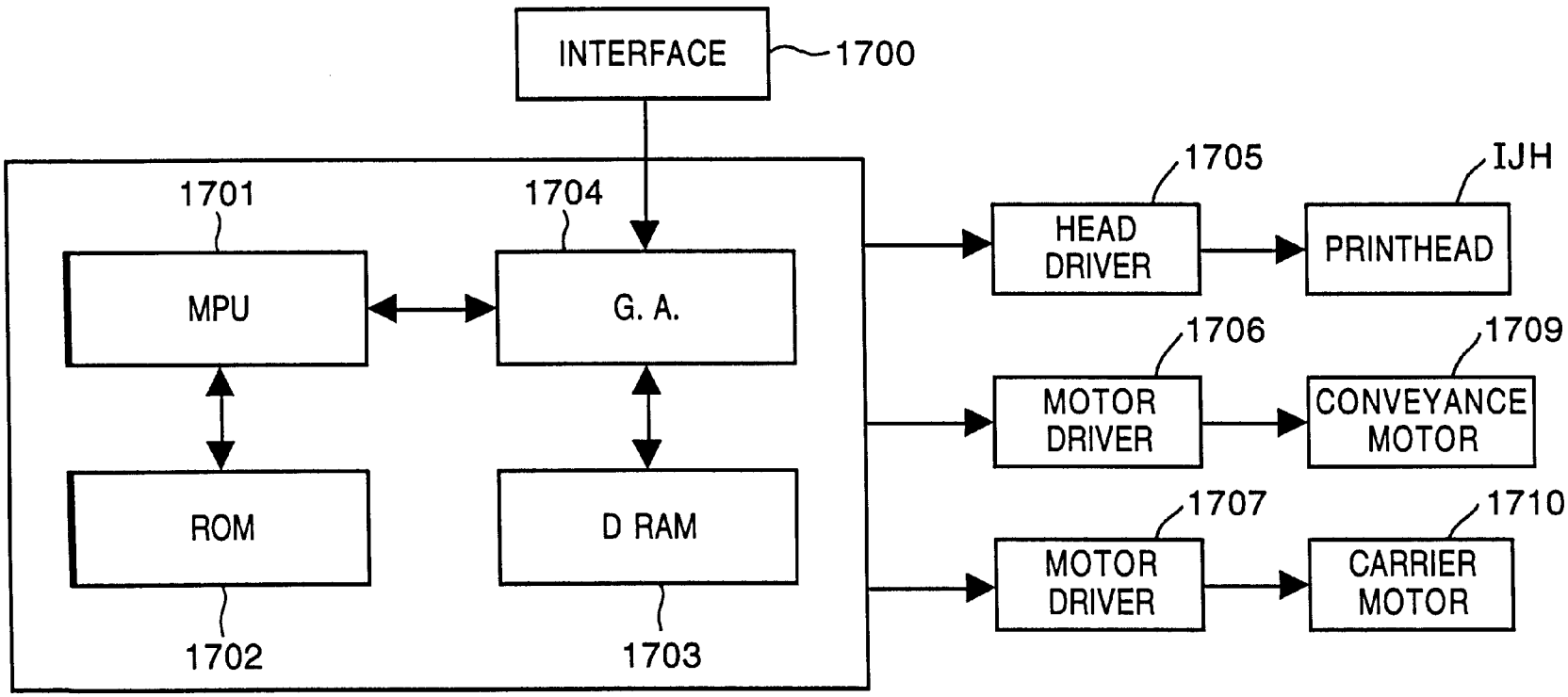
FIG. 3 is a block diagram showing the arrangement of a control circuit of the printer shown in FIG. 1.

Hereinafter, description will be provided on the control circuit for executing print control of the above-described printer. FIG. 3 is a block diagram showing the arrangement of a control circuit of the ink-jet printer IJRA. Referring to FIG. 3 showing the control circuit, reference numeral 1700 denotes an interface for inputting an image signal; 1701, an MPU; 1702, a ROM for storing a control program executed by the MPU 1701; and 1703, a DRAM for storing various data (aforementioned image signals, or image data supplied to the printing head IJH, and the like). Reference numeral 1704 denotes a gate array (G.A.) for performing supply control of image data to the printing head IJH. The gate array 1704 also performs data transfer control among the interface 1700, the MPU 1701, and the DRAM 1703. Reference numeral 1710 denotes a carrier motor for conveying the printing head IJH; and 1709, a conveyance motor for conveying a printing sheet. Reference numeral 1705 denotes a head driver for driving the printhead IJH; and 1706 and 1707, motor drivers for driving the conveyance motor 1709 and the carrier motor 1710.

The operation of the aforementioned control structure is now described. When an image signal is inputted to the interface 1700, the image signal is converted to print data by the gate array 1704 and MPU 1701 intercommunicating with each other. As the motor drivers 1706 and 1707 are driven, the printhead IJH is driven in accordance with the print data transferred to the head driver 1705, thereby performing printing.

Next, description will be provided on several embodiments commonly utilizing the printer having the above-described configuration.

First Embodiment

Figure 4:
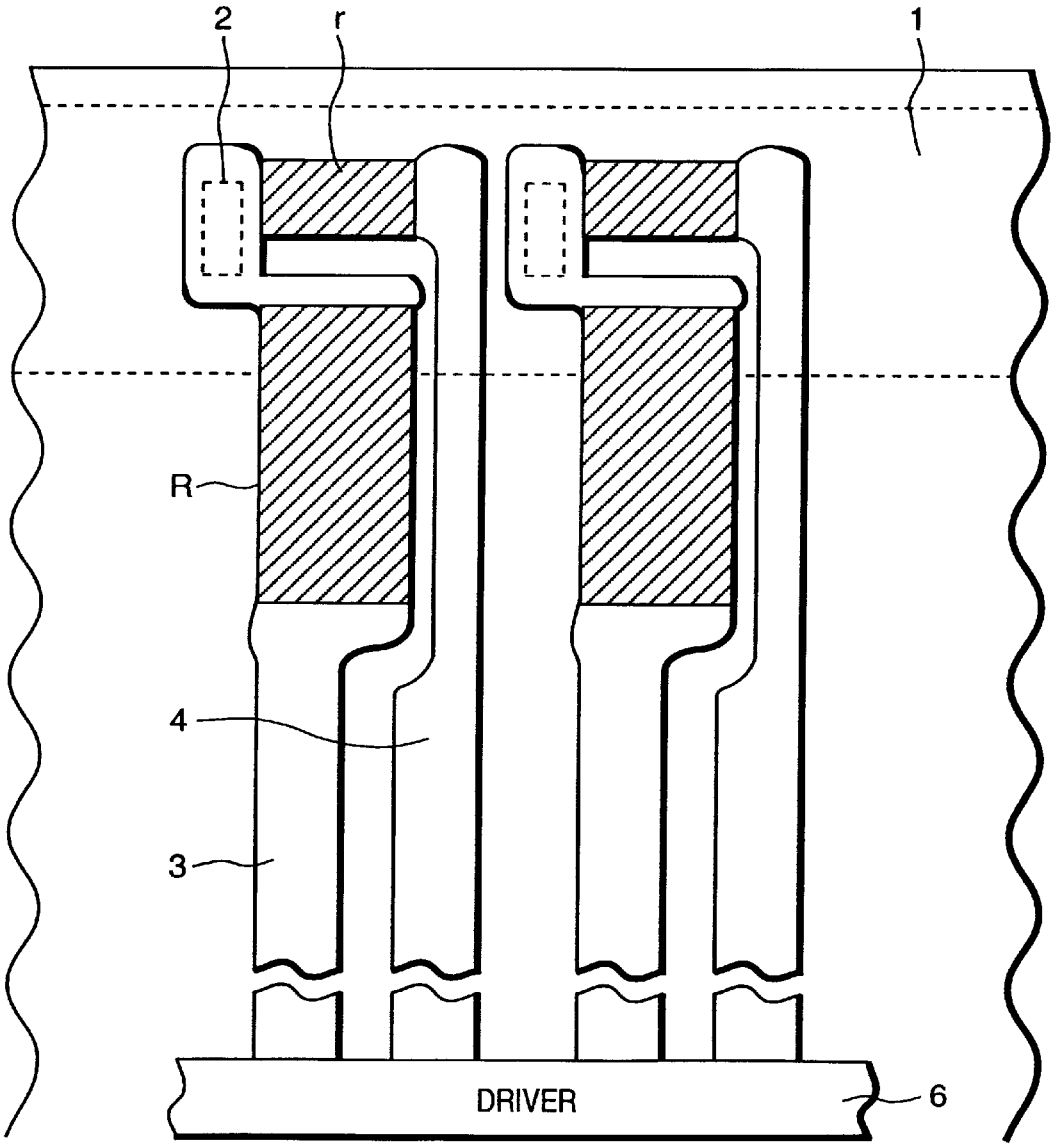
FIG. 4 is a partial view of a substrate for a driving circuit of a printhead incorporating a heater.
Figure 5:
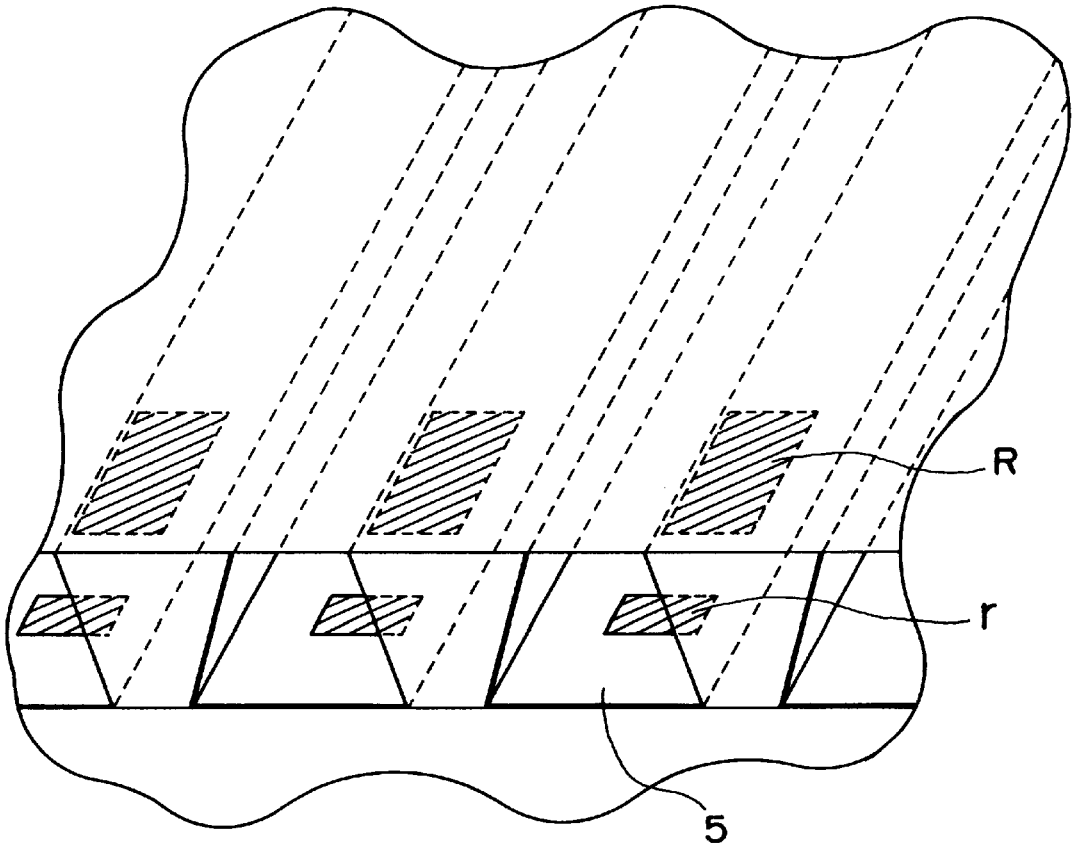
FIG. 5 is an enlarged view of a nozzle portion of a printhead.

Detailed Description of Printhead (FIGS. 4 and 5)

The arrangement of the printhead will now be described in detail. FIG. 4 is a partial view of a substrate for a driving circuit of a printhead incorporating a heater. The circuit's substrate is a multilayer substrate where a device in one layer is wired to a device in another layer via through hole provided at each layer. FIG. 5 is an enlarged view of a nozzle portion of the printhead.

Although the configuration of a printhead may vary, in the following description, the printhead includes two types of heaters in one ink channel used for discharging ink, and includes 64 ink channels and 64 ink-discharge nozzles.

Among the two types of heaters shown in FIG. 4, the one that discharges a large ink droplet is a main heater R and the one that discharges a small ink droplet is a sub heater r. One end of a lead line 3 of the main heater R is connected to a heating power supply line 1 at the lower layer via a through hole 2. The other end of the lead line 3 is connected to a driver 6. Meanwhile, one end of a lead line 4 of the sub heater r is also connected to the heating power supply line 1 at the lower layer via the same through hole 2, and the other end of the lead line 4 is connected to the driver 6.

As shown in FIG. 5, the main heater R and sub heater r are arranged inside a nozzle 5. When the nozzle 5 is filled with ink and a predetermined voltage is applied to the main heater R and/or sub heater r, bubbles are generated. Because the size of the main heater R and that of the sub heater r are different, the sizes of the generated bubbles vary, thus the amount of ink discharged from the nozzle 5 can be changed. In other words, by utilizing three different driving ways: driving only the main heater R, or driving only the sub heater r, or driving both the main heater R and sub heater r, it is possible to discharge different sizes of ink droplets, a large ink droplet, a medium ink droplet and a small ink droplet. In addition, since the driver 6 includes two heat enable terminals, the main heater R and sub heater r can be independently driven. Therefore, the amount of discharging ink droplet and discharging speed can be set at a desired value. Similarly, even in a case where the main heater R and sub heater r are simultaneously driven to discharge a larger ink droplet, these heaters can be driven independently. Therefore, the degree of bubble formation can be controlled subtly, enabling to set the amount of discharging ink droplet and discharging speed at a desired value.

Note that according to the printhead IJH of the present embodiment, the heating level or the contact area of the heater to ink are adjusted such that the amount of ink discharged by driving both the main heater R and the sub heater r is almost equal to the amount of ink discharged by a conventional printhead where each nozzle has one heater.

Figure 6:
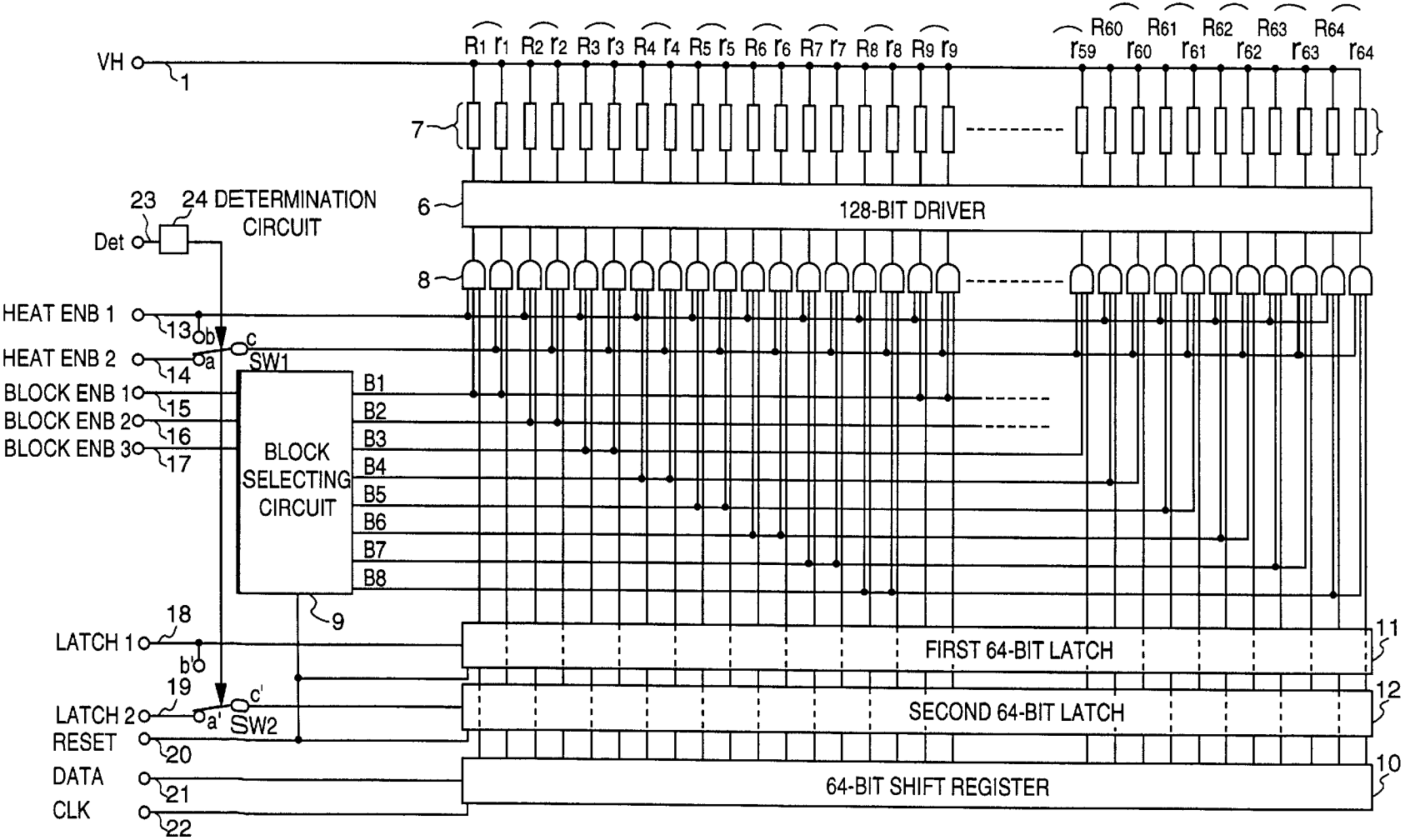
FIG. 6 is a circuit diagram for driving a printhead.
Figure 7:
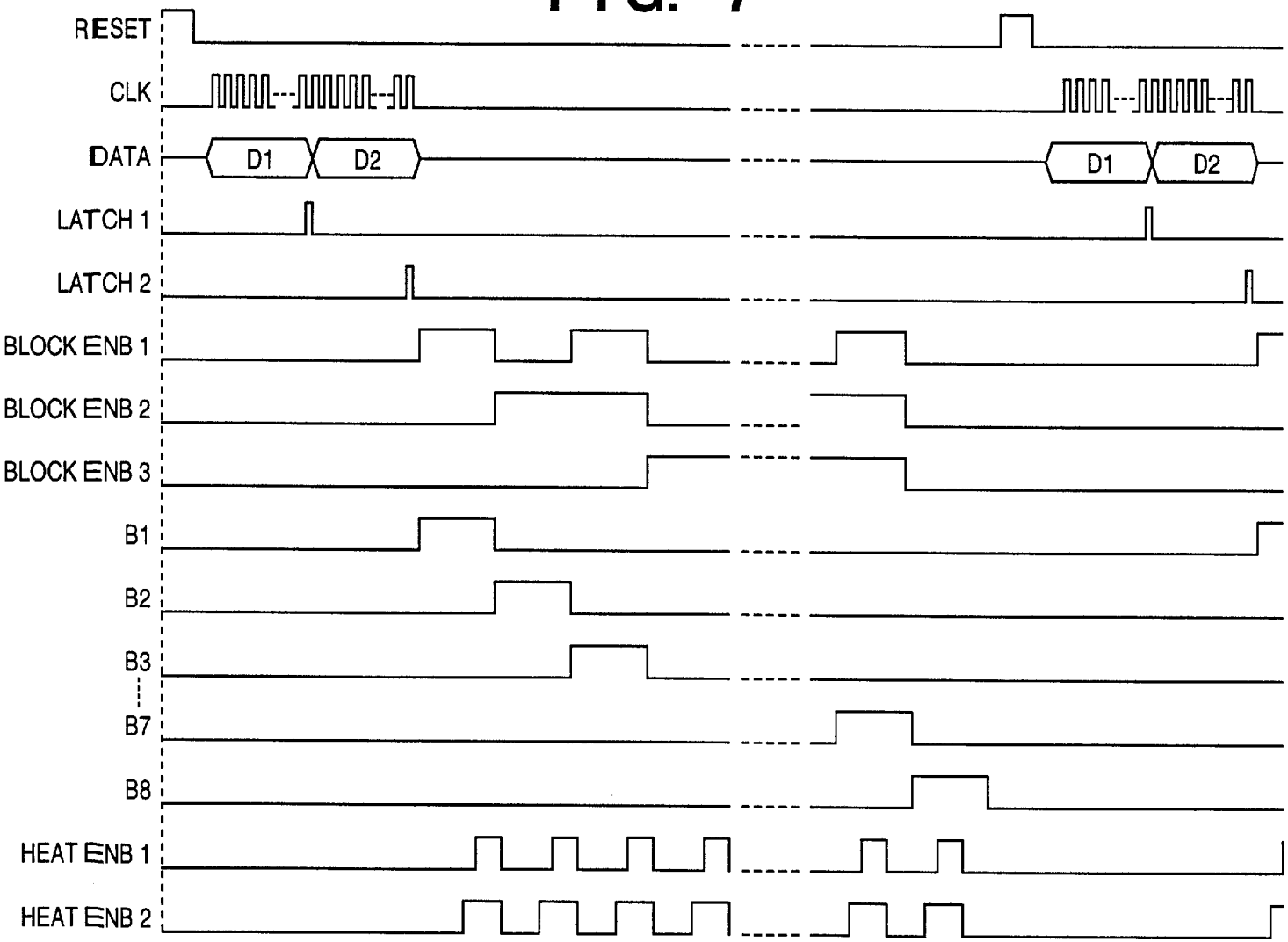
FIG. 7 is a timing chart of the circuit diagram shown in FIG. 6.
Figure 8:
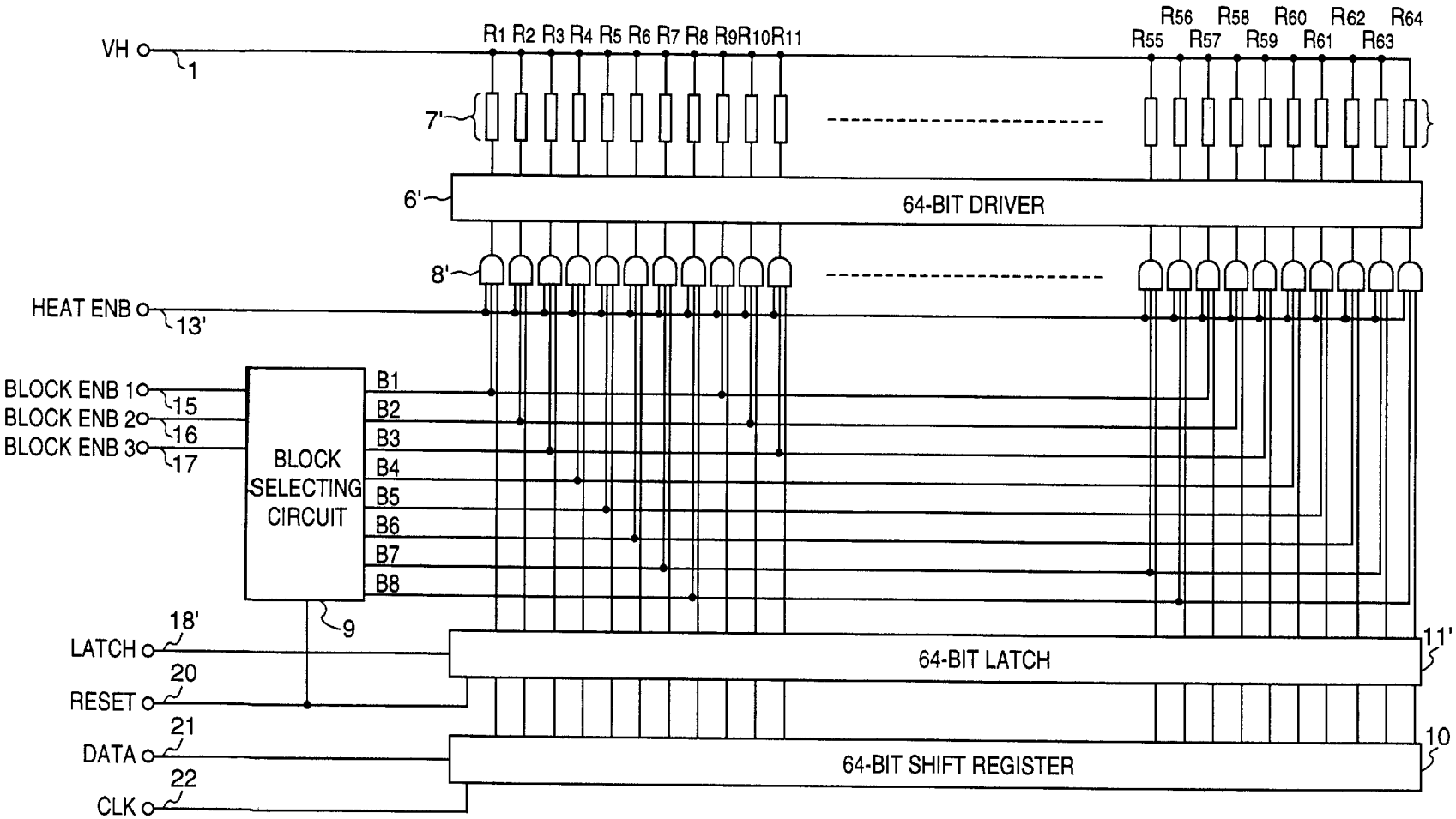
FIG. 8 is a circuit diagram for driving a print head having 64 nozzles, each having one heater.

Driving Circuit of Printhead (FIGS. 6–8)

The arrangement of the driving circuit for the printhead will now be described in detail. FIG. 6 is a circuit diagram for driving the printhead; and FIG. 7, a timing chart of the operation executed in the circuit in FIG. 6.

As shown in FIG. 6, a power supply unit VH is connected to the heating power supply line 1 which supplies power and applies voltage to a heater group 7 consisting of the main heaters R1 to R64 and sub heaters r1 to r64. The heater group 7 is connected to an output terminal of the driver 6 which drives the total of 128 heaters, R and r, i.e., 64 main heaters R and 64 sub heaters r. The 128 gate circuits 8, each connected to an input terminal of the driver 6, respectively output a pulse to turn on the driver 6, thereby turning on the heater group 7.

The printhead IJH according to the present embodiment operates differently depending on the following two cases:

(1) the printhead is installed in a printer which performs printing by driving both or one of the 64 main heaters and/or 64 sub heaters; and (2) the printhead is installed in a printer which is designed to perform printing by driving only the 64 main heaters. The operation in each of the cases (1) and (2) will be described below.

(1) The case where the IJH is installed in a printer which can control driving of both or one of the 64 main heaters and/or 64 sub heaters It is assumed herein that the printer incorporating the printhead IJH has a signal supply terminal in the carriage HC so that signals are supplied to a determination circuit to be described below. In this case, the printer operates to make the sufficient use of the function of the printhead IJH.

The printer first resets serial data latched in the first 64-bit latch 11 and second 64-bit latch 12, by transferring a reset signal (RESET) to a reset terminal 20. Then serial data (DATA) for the main heaters R1–R64, which is generated on the basis of image data and which corresponds to each nozzle, is inputted to a data input terminal 21 of the 64-bit shift register 10 in synchronization with a clock pulse (CLK) inputted to a clock terminal 22. As a result, data D1 is captured by the 64-bit shift register 10. The data D1 is then latched in the first latch 11 by a latch signal (LATCHL) inputted to a latch terminal 18. Similarly, serial data (DATA), for the sub heaters r1–r64, which corresponds to each nozzle is inputted to the data input terminal 21 of the 64-bit shift register 10 in synchronization with a clock pulse (CLK) inputted to the clock terminal 22. As a result, data D2 is captured by the 64-bit shift register 10. The data D2 is then latched in the second latch 12 by a latch signal (LATCH2) inputted to a latch terminal 19.

If all the heaters R and r are to be driven simultaneously, a large amount of electricity is required and it is not practical. Therefore, a block selecting circuit 9 divides the heater group 7 into a predetermined blocks B1–B8 to drive the heaters R and r by the time-divisional drive control. For this, the block selecting circuit 9 has block enable terminals 15, 16 and 17 to select one of the blocks. As shown in FIG. 7, one of the block-selecting signals (B1–B8) is set at HIGH level in accordance with a combination of levels (HIGH/LOW) of the block enable signals (BLOCK ENB1, BLOCK ENB2, BLOCK ENB3), thereby selecting a block of the heaters R and r to be driven.

A determination circuit 24 (FIG. 6) is provided to determine the type of the printer. For instance, in the case of the printer (1), a predetermined signal is sent from the printer via a determination terminal 23. An output of the determination circuit 24 is inputted to control-signal input terminals of switches SW1 and SW2. The switch SW1 connects a terminal c with either a terminal a or terminal b, in accordance with the output signal, from the determination circuit 24, which is inputted to the control-signal input terminal. As a result, if the terminal c is connected to the terminal b, a heat enable signal (HEAT ENB1), inputted to a heat enable terminal 13, drives the main heater R and sub heater r simultaneously. If the terminal c is connected to the terminal a, heat enable signals (HEAT ENB1 and HEAT ENB2), respectively inputted to heat enable terminals 13 and 14, drive the main heater R and sub heater r independently. The switch SW2 connects a terminal c' with either a terminal a' or a terminal b' in accordance with an output signal of the determination circuit 24, which is inputted to the control-signal input terminal. As a result, if the terminal c' is connected to the terminal b', a latch signal (LATCH1) is inputted to the latch terminal 18, simultaneously latching the data corresponding to the main heater R and sub heater r in the first 64-bit latch 11 and the second 64-bit latch 12. If the terminal c' is connected to the terminal a', latch signals (LATCH1 AND LATCH2) are respectively inputted to the latch terminals 18 and 19, separately latching the data in the first 64-bit latch 11 and the second 64-bit latch 12 from the 64-bit shift register 10.

According to the present embodiment, when a determination signal (Det) at high level is inputted to the determination terminal 23, the determination circuit 24 outputs a signal respectively to the switches SW1 and SW2 to connect the terminal c to the terminal a, and the terminal c' to the terminal a'. As a result, the main heater R and sub heater r are driven independently by respective heat enable signals (HEAT ENB1 and HEAT ENB2) and respective latch signals (LATCH1 and LATCH2). Meanwhile, when a determination signal (Det) at low level is inputted, the determination circuit 24 outputs a signal respectively to the switches SW1 and SW2 to connect the terminal c to the terminal b, and the terminal c' to the terminal b'. As a result, the main heater R and sub heater r are driven simultaneously by the single heat enable signal (HEAT ENB1) and the single latch signal (LATCH1).

Note that the printer incorporating the printhead IJH includes, in the carriage HC, the terminal which can provide the determination signal (Det) to the determination terminal 23. If the printhead IJH is mounted on a carriage which does not have such terminal, the determination terminal 23 becomes electrically non-connected. In this case, the switches SW1 and SW2 unconditionally connect the terminal c to terminal b and the terminal c' to terminal b'.

Accordingly, in the above described driving circuit, the block selecting circuit 9 selects a block of heaters to be driven, and a predetermined driving waveform is inputted to the selected heat enable terminal 13 and/or heat enable terminal 14 by the switch SW1, thereby making it possible to discharge a desired amount of ink droplet at a desired discharging speed from a desired nozzle.

(2) The case where the IJH is installed in a printer which is designed to perform printing by driving only the 64 (main) heaters Herein, description is provided on a printer, such as those available conventionally, in which the printer incorporating the printhead IJH does not have the function to supply a determination signal (Det) to the determination circuit 24. In the case of such apparatus, even if the printhead IJH is mounted on the carriage HC, the determination terminal 23 is electrically non-connected. Thus, the switches SW1 and SW2 unconditionally connect the terminal c to terminal b and the terminal c' to terminal b'.

Therefore, in this case, the control for the driving circuit of the printhead IJH substantially becomes equivalent to that for the driving circuit shown in FIG. 8. Referring to FIG. 8, the power supply unit VH is connected to the heating power supply line 1 which supplies power and applies voltage to a heater group 7' consisting of heaters R1 to R64. The heater group 7' is connected to an output terminal of a 64-bit driver 6' which drives 64 heaters R. The 64 gate circuits 8', each connected to an input terminal of the 64-bit driver 6', respectively output a pulse to turn on the driver 6', thereby turning on the heater group 7'. With relation to FIG. 8, those components that are identical to those of the circuit in FIG. 6 will be referred by the same reference numerals and description thereof will be omitted.

The operation of the printhead IJH is now described by comparing FIG. 6 and FIG. 8. Depending on the connection of switches SW1 and SW2, the heat enable terminal 14 and the latch terminal 19 do not function; thus, only the heat enable signal (HEAT ENB1) inputted from the heat enable terminal 13 and the latch signal (LATCH1) inputted from the latch input terminal 18 drive the main heater R and sub heater r simultaneously to generate heat. In other words, by utilizing the driving circuit shown in FIG. 6, an ink droplet can be discharged in the condition identical to the condition where the driving circuit shown in FIG. 8 is used.

According to the above-described embodiment, in a case where the printhead IJH is installed in a printer having the function to provide two types of heat enable signals, two types of latch signals, and a determination signal (Det) which is to be sent to the determination terminal 23, it is possible to adjust the amount of ink discharge by controlling the main heater and sub heater provided in each nozzle such that they are driven simultaneously or independently As a result, it is possible to perform printing in high tonality. Meanwhile, in a case where the printhead IJH is installed in a printer not having the function to provide a determination signal (Det), it is still possible to perform printing because a single heat enable signal can automatically set the main heater and sub heater to be driven simultaneously.

As set forth above, when the printhead IJH is installed in a high-performance printer, the printhead utilizes the capability and function of the apparatus to its full capacity, and when the printhead IJH is installed in the conventional printer, the printhead operates to conform with the capability of the apparatus. In other words, the printhead IJH is compatible with both the conventional-type and new-type printers. Particularly, in the case the printhead is utilized in the conventional apparatus, the interior of the printhead is automatically set so that the signal interface is comformable to the apparatus, without any particular interfaces included in the apparatus.

Second Embodiment

It is assumed in the second embodiment that the ink-jet printer IJRA shown in FIG. 1 is able to perform printing at print density of 720 dpi with the printhead IJH whose arrangement is to be described later. To perform printing at the density of 720 dpi by driving the printhead IJH, the printer is arranged to supply an STA signal (to be described later) and two latch clock signals (LTCLK1 and LTCLK2) via the head driver 1705 (FIG. 3). Furthermore, data transfer operation to the printhead IJH is controlled such that image data (odd-number dots) is first transferred to heaters of the odd-number nozzles, then the image data (even-number dots) is next transferred to heaters of the even-number nozzles.

Internal Arrangement of Printhead IJH

Figure 9:
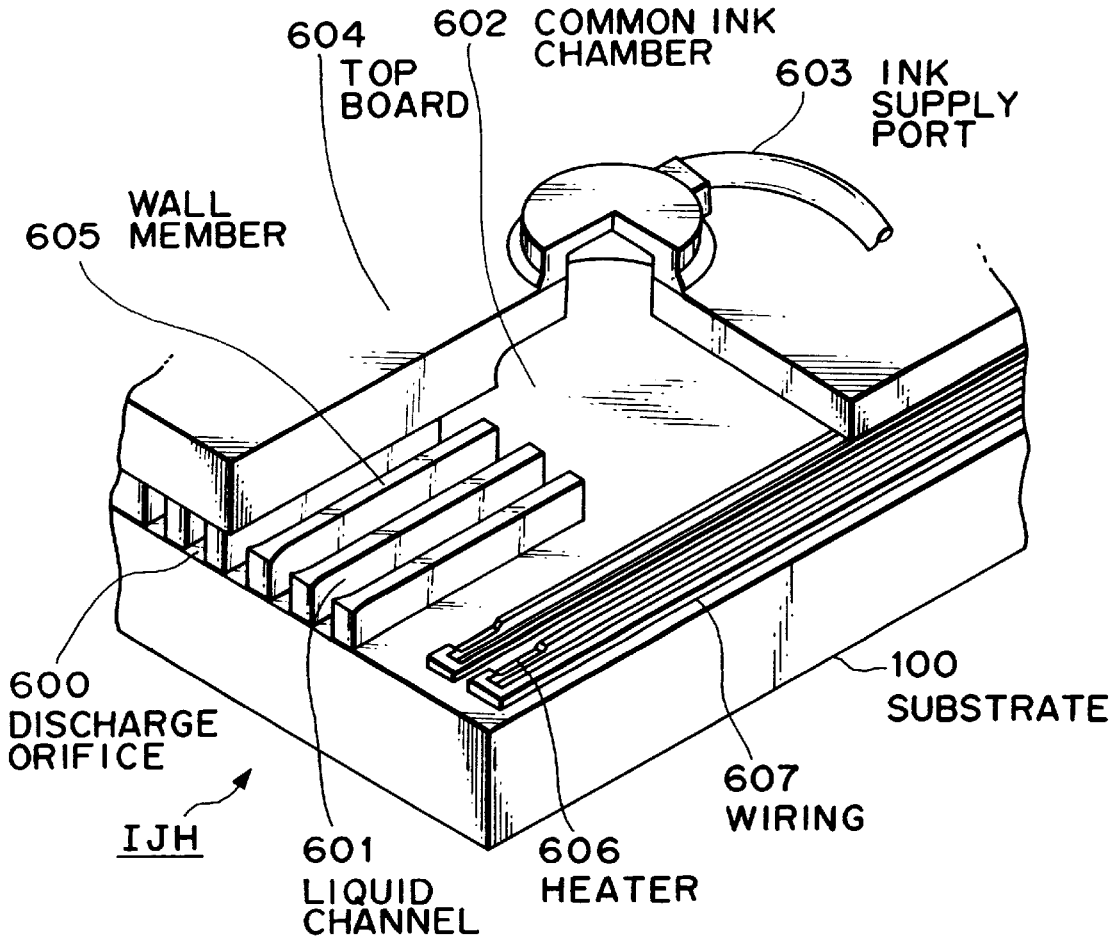
FIG. 9 is a perspective partially cut-out view showing an internal configuration of a printhead installed in the printer shown in FIG. 1.

FIG. 9 is a perspective partially cut-out view showing the internal configuration of the printhead IJH.

Referring to FIG. 9, reference numeral 100 denotes a substrate integrating the logical circuit to be described later; 600, a discharge orifice for discharging ink; 601, an ink liquid channel; 602, a common ink chamber connected to a plurality of the ink liquid channels for temporarily reserving ink; 603, an ink supply port for supplying ink from an ink tank (not shown); 604, a top board; 605, a wall member forming the ink liquid channel 601 coupled with the top board 604; 606, a heater; and 607, wiring for connecting the logical circuit with the heater 606.

The logical circuit, heater 606 and wiring 607 are formed on the substrate 100 by utilizing a semiconductor manufacturing process. The top board 604, to which the ink supply port 603 is attached, and the wall member 605 are mounted on the substrate, and the printhead IJH is constructed. Ink is provided from the ink supply port 603, reserved in the common ink chamber 602 and supplied to each ink liquid channel 601. As the heater 606 is driven in this condition, the ink is discharged from the discharge orifice 600.

Arrangement of Logical Circuit of Printhead IJH

Figure 10:
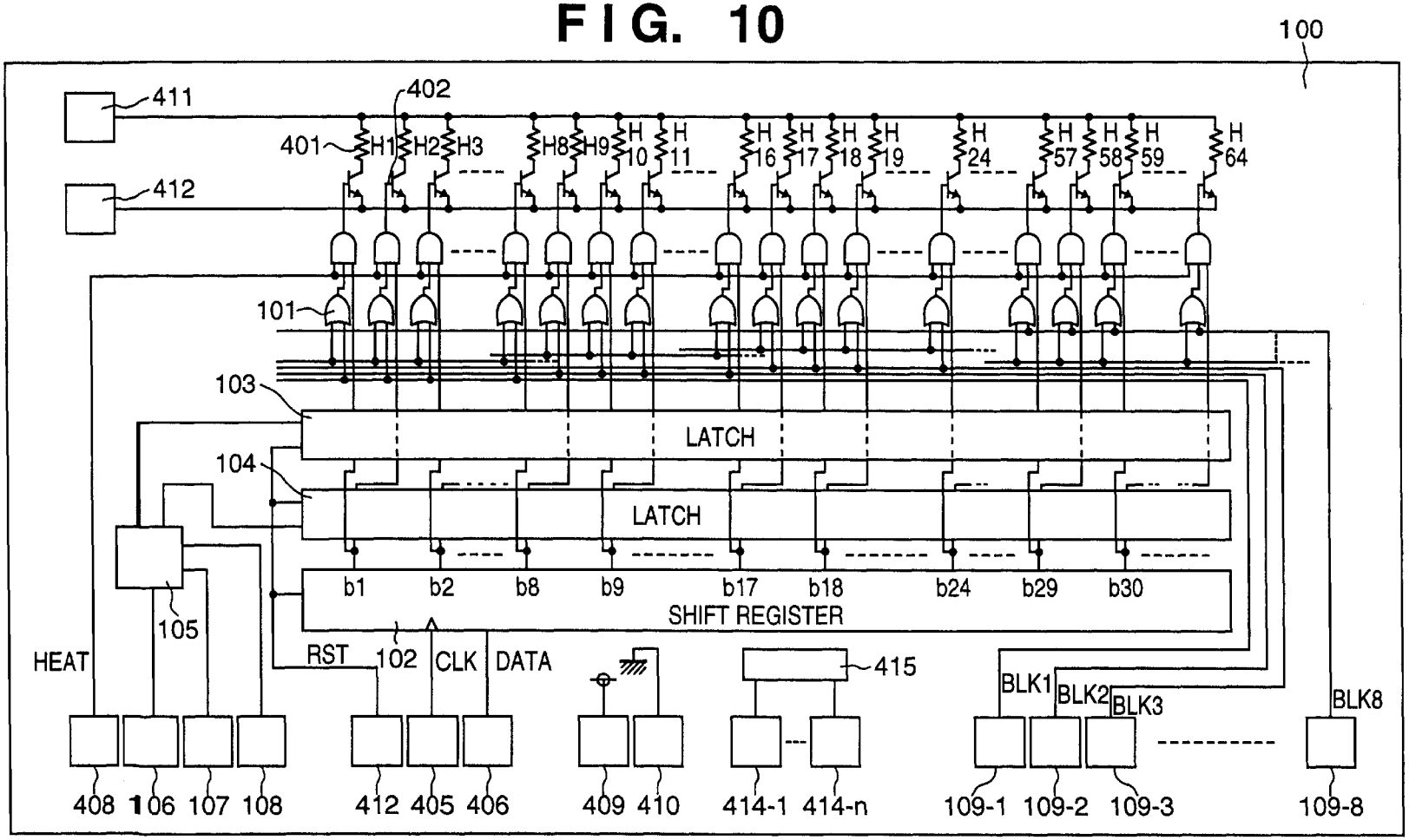
FIG. 10 is a block diagram showing configuration of a logical circuit of a printhead installed in the printer shown in FIG. 1.

FIG. 10 is a block diagram showing configuration of the logical circuit of the printhead IJH according to the present embodiment. In FIG. 10, components and signals identical to those in the conventional printhead described with reference to FIG. 14 will be referred by the same reference numerals and reference letters, and description thereof will be omitted.

The printhead IJH described herein is installed in a printer capable of printing at 360 dpi and a printer capable of printing at 720 dpi, and the printhead IJH is capable of printing at either print density (360 dpi/720 dpi). The amount of ink discharged by the printhead IJH for a single dot is about 20 ng. The printhead IJH has 64 heaters (H1 to H64), and print width thereof is equal to that of the conventional printhead having 32 heaters, which has been described with reference to FIGS. 14 and 15. Meanwhile, in the case of the printhead described in FIGS. 14 and 15 which is capable of printing at 360 dpi, the amount of ink discharged for a single dot is about 80 ng.

Referring to FIG. 10, reference numeral 101 denotes an OR circuit; 102, 32-bit shift register (same as the conventional shift register 404 shown in FIG. 14); 103 and 104, 32-bit latch circuits; 105, a printer recognizing unit; 106, an STA-signal input pad; and 107 and 108, latch-clock input pads for respectively supplying latch clock signals (LTCLK1 and LTCLK2) to the latch circuits 103 and 104. Reference numerals 109-1, 109-2, 109-3, . . . , 109-8 denote block-selecting-signal input pads which respectively input eight block-selecting signals (BLK1, BLK2, . . . , BLK8).

Figure 14:
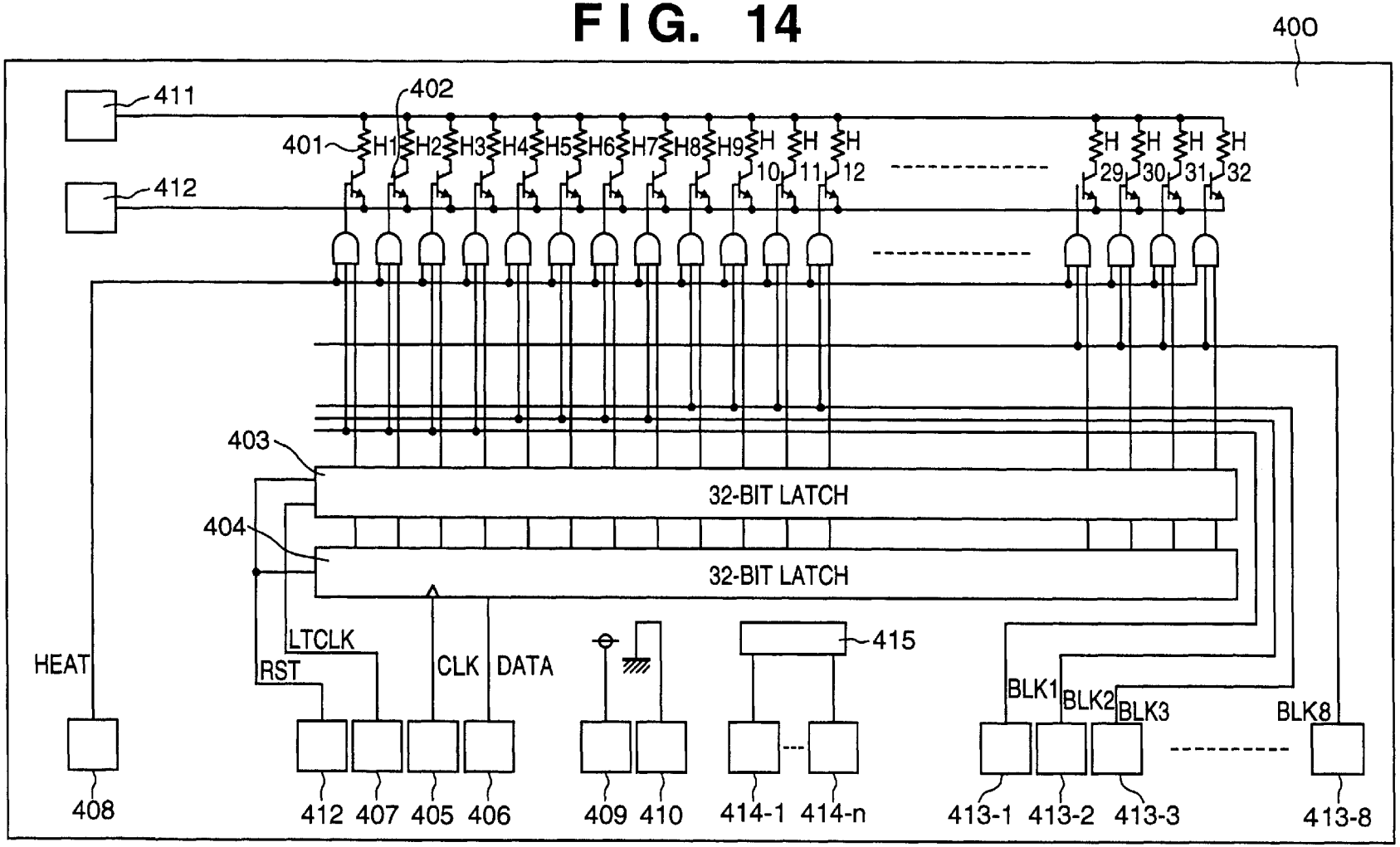
FIG. 14 is a block diagram showing configuration of a logical circuit of a conventional printhead.

Comparing the configuration shown in FIG. 10 with the configuration of the conventional printhead shown in FIG. 14, in the conventional printhead, a single block-selecting signal (BLK1–BLK8) selects heaters corresponding to one block in one print cycle, but in the present embodiment, the same block-selecting signal selects heaters corresponding to two blocks in one print cycle.

More specifically, the block-selecting signal (BLK1) inputted from the block-selecting-signal input pad 109-1 selects heaters H1 to H8 and heaters H33 to H40. The block-selecting signal (BLK2) inputted from the block-selecting-signal input pad 109-2 selects heaters H9 to H16 and heaters H41 to H48. The block-selecting signal (BLK3) inputted from the block-selecting-signal input pad 109-3 selects heaters H17 to H24 and heaters H49 to H56. The block-selecting signal (BLK4) inputted from the block-selecting-signal input pad 109-4 selects heaters H25 to H32 and heaters H57 to H64. The block-selecting signal (BLK5) inputted from the block-selecting-signal input pad 109-5 selects heaters H33 to H40 and heaters Hi to H8. The block-selecting signal (BLK6) inputted from the block-selecting-signal input pad 109-6 selects heaters H41 to H48 and heaters H9 to H16. The block-selecting signal (BLK7) inputted from the block-selecting-signal input pad 109-7 selects heaters H49 to H56 and heaters H17 to H24. The block-selecting signal (BLK8) inputted from the block-selecting-signal input pad 109-8 selects heaters H57 to H64 and heaters H25 to H32.

In other words, in a case where heaters are divided into blocks and driven by the time-divisional drive control, if a block-selecting signal is supplied sequentially from BLK1 to BLK8, each heater is driven twice in one print cycle of the printhead. By virtue of the above-described configuration of the logical circuit of the printhead, the number of times where the heaters are selected in one print cycle is increased; thus, one nozzle discharges ink twice in one print cycle.

In addition, while output of each bit of the shift register 404 is connected to the latch circuit 403 of the conventional printhead in one-to-one basis (see FIG. 14), in the present embodiment, output of each bit of the shift register 102 is connected respectively to the latch circuits 103 and 104 (See FIG. 10). In other words, output-of each bit of the shift register 102 is connected to the latch circuits 103 and 104 in one-to-two basis. This is due to the fact that the number of heaters (64 heaters) is twice as many as the number of the heaters of the conventional printhead described in FIGS. 14 and 15; therefore, in order to perform printing at density of 720 dpi, the capacity of a data memory for holding image data must be twice as large. As described above, even if the data capacity of the shift register has not been changed, the shift register is used plural times and latch operation is performed each time, thereby holding data twice as large as the conventional data in correspondence to the double number of heaters.

Furthermore, as shown in FIG. 10, outputs of the latch circuit 103 are used to drive the heaters H1, H3, H5, . . . , H63, while outputs of the latch circuit 104 are used to drive the heaters H2, H4, H6, . . . , H64.

The printer recognizing unit 105 will now be described in detail.

Figure 11:
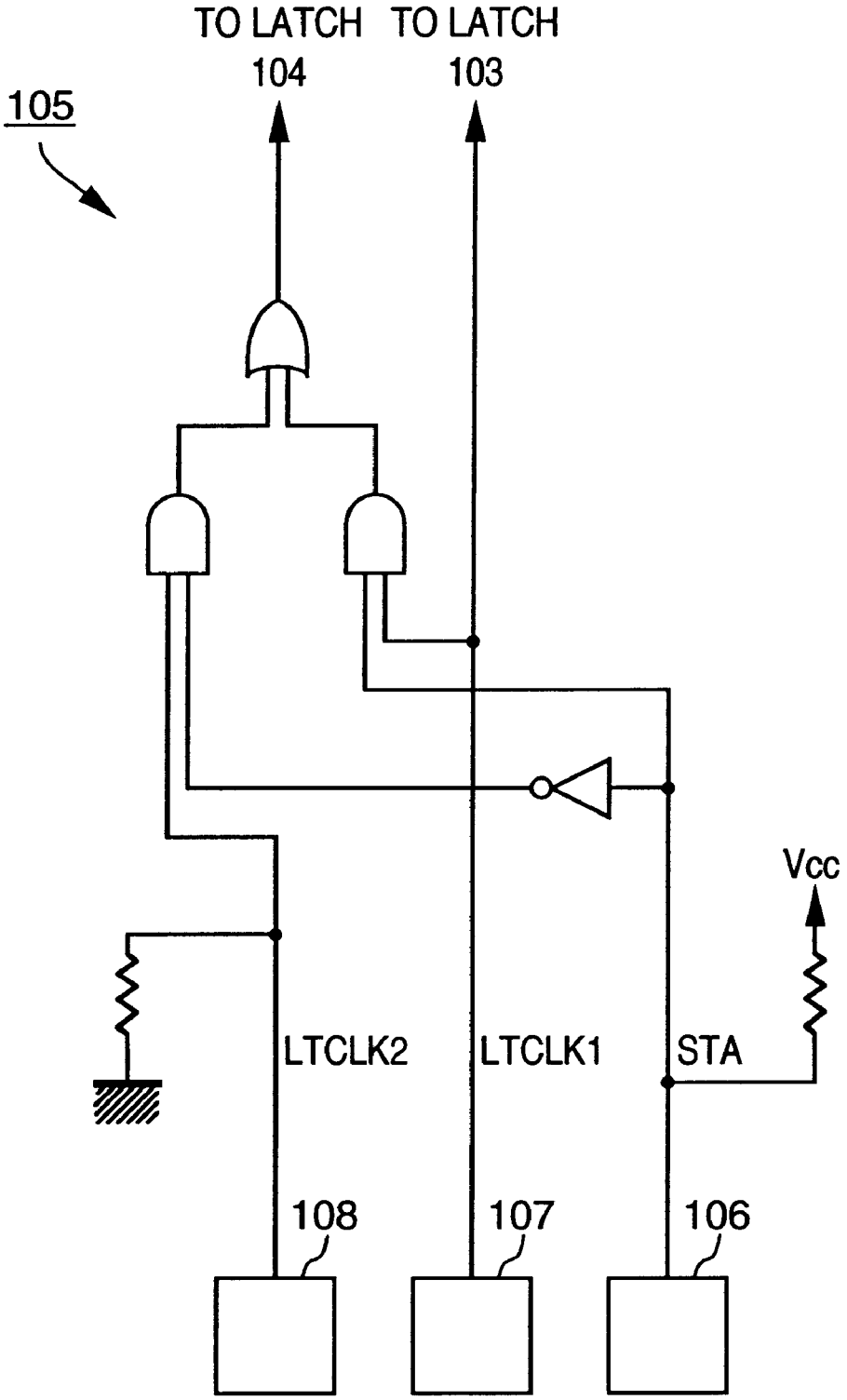
FIG. 11 is a circuit diagram showing details of a printer recognizing unit 105.

FIG. 11 is a circuit diagram showing details of the printer recognizing unit 105.

The printer recognizing unit 105 recognizes whether the printer, into which the printhead IJH is installed, operates with the printhead capable of printing at 360 dpi or with a printhead capable of printing at 720 dpi.

It is assumed herein that the printer (hereinafter referred to as a "new-type printer"), which operates with the printhead capable of printing at 720 dpi, can output a "Low True" STA signal to the STA-signal input pad 106 of the printer recognizing unit 105 and output a latch clock (LTCLK2) to the latch-clock input pad 108. On the other hand, the printer (hereinafter referred to as a "conventional-type printer"), which operates with the printhead capable of printing at 360 dpi, does not have the function to output the STA signal or latch clock (LTCLK2), nor does it include an interface for the STA-signal input pad or the latch-clock input pad 108. Thus, electrical connection to these pads are open. The other latch clock (LTCLK1) is inputted to the latch-clock input pad 107. Note that herein the latch clock (LTCLK1) is assumed to be the same signal as the conventional latch clock (LTCLK).

Accordingly, in the case where the printhead IJH is installed in the conventional-type printer, an interface is established between the latch-clock input pad 107 and the printer, whereby supplying a latch clock (LTCLK). When the latch clock (LTCLK or LTCLK1) is supplied from the latch-clock input pad 107, image data is held by the latch circuit 103. Further, as apparent from the configuration shown in FIG. 11, the STA signal in this case is "HIGH". Therefore, the latch clock (LTCLK or LTCLK1) is also supplied to the latch circuit 104. As a result, the same data is latched in the latch circuits 103 and 104 by the one latch clock. Accordingly, as the same data is latched in the latch circuits 103 and 104, pairs of adjacent heaters H1 and H2, H3 and H4, H5 and H6, . . . , H63 and H64 are driven by the same data.

Meanwhile, in the case where the printhead IJH is installed in the new-type printer, an interface is also established between the latch-clock input pad 108 and the printer. When the latch clock (LTCLK2) is supplied, the image data is held by the latch circuit 104.

With the aforementioned assumption, according to the present embodiment, in a case where the printhead IJH is installed in the conventional-type printer, the STA-signal input pad 106 becomes open and is pulled up to automatically produce a "HIGH" STA signal so that the printhead IJH can recognize that the printer is the conventional type. Meanwhile, the latch-clock input pad 108 is connected to GND via a resistance. Accordingly, malfunction which might occur in the circuit utilizing a CMOS semiconductor at the time the connection of the latch-clock input pad 108 is open, can be prevented.

As a matter of course, the STA-signal input pad 106 may have a structure to be pulled down instead of pulled up, and the subsequent logic may be reversed.

Next, printing operation will be described with reference to FIGS. 12 and 13, in a case where the printhead IJH is installed in (1) the conventional-type printer, and a case where it is installed in (2) the new-type printer.

(1) Printing operation performed in a case where the printhead is installed in the conventional-type printer In this case, the STA signal becomes "HIGH." Thus, as described above, the same data is held by the latch circuits 103 and 104 by a single latch clock (LTCLK or LTCLK1). As the block-selecting signals BLK1 to BLK8 are sequentially supplied in this condition, the 64 heaters of the printhead IJH are driven twice in one print cycle.

In other words, all the 64 heaters have a chance to be driven at least once during the period of supplying the block-selecting signals BLK1 to BLK4 (i.e. half of the one print cycle). Since a pair of adjacent heaters is driven by the same data, a pair of print dots are printed next to each other in the direction of a print width of the printhead, at the print density of 720 dpi.

As the remaining block-selecting signals BLK5 to BLK8 are supplied successively, the 64 heaters are given another chance to be driven. At this stage, the same data as that used in the previous printing is still held in the latch circuits 103 and 104, thus printing operation is performed based on the same data. Since the carriage loading the printhead is moved in the scanning direction of the carriage in the printer to perform printing at density of 360 dpi, dots which are printed by ink discharge caused by the block-selecting signals BLK5 to BLK8 are formed next to those dots formed by the pervious block-selecting signals BLK1 to BLK4, in the carriage scanning direction.

Figure 12A:
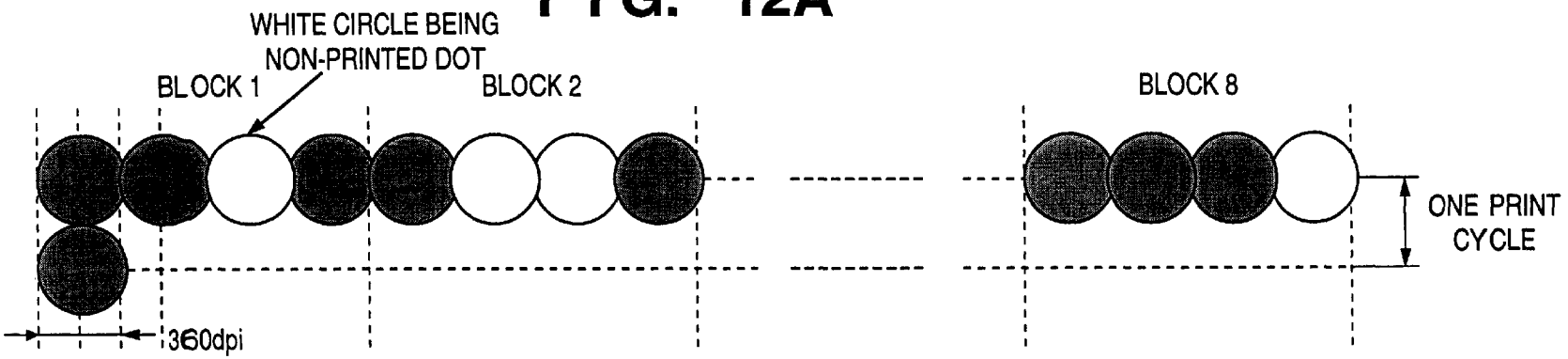
FIGS. 12A–12C are views for comparing print dots printed by a conventional printhead and print dots printed by a printhead shown in FIGS. 9 and 10.
Figure 12B:
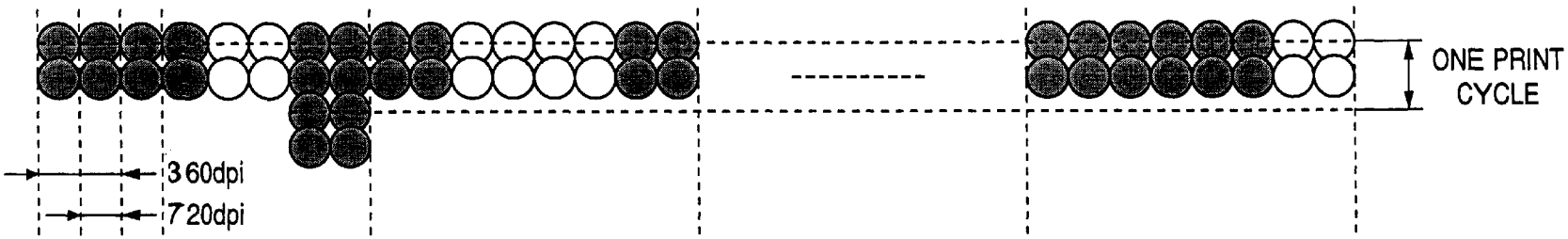

The printed dots formed in the above-described manner have the arrangement shown in FIG. 12B.

Figure 15:
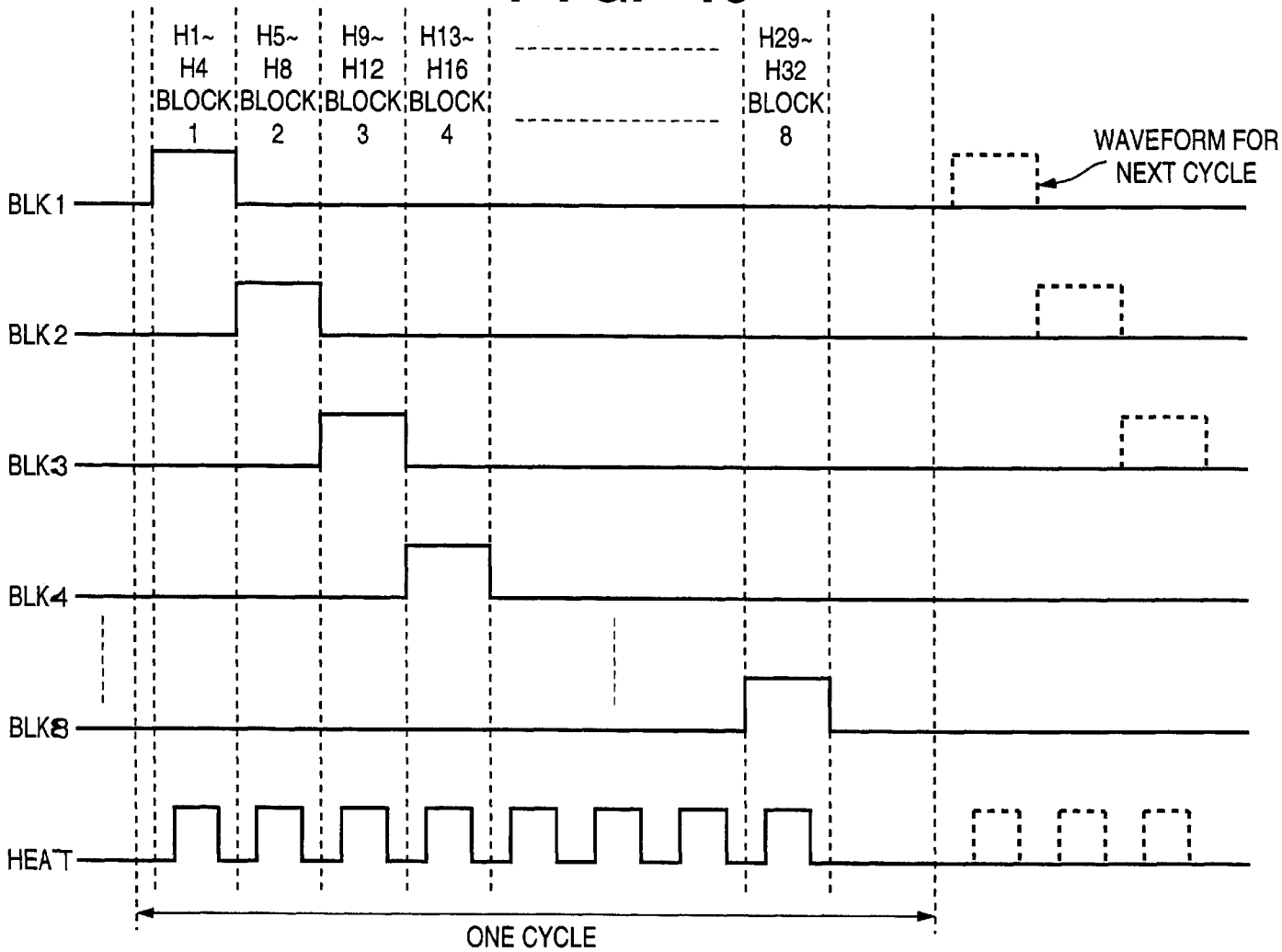
FIG. 15 is a timing chart of control signals for driving a printhead having the configuration shown in FIG. 14.

The printed dots in FIG. 12B are compared with the printed dots in FIG. 12A formed by the conventional-type printer (print density 360 dpi) incorporating the conventional printhead which can print at 360 dpi (see FIGS. 14 and 15). In a print area where one dot is printed in FIG. 12A, four dots are printed in FIG. 12B by the same data. As a result, substantially the same printing is performed in FIGS. 12A and 12B.

(2) Printing operation performed in a case where the printhead is installed in the new-type printer In this case, the STA signal is "LOW." Thus, as has been described above, 32-bit data and the subsequent 32-bit data are respectively held by the latch circuits 103 and 104 in accordance with the two latch clocks (LTCLK1 or LTCLK2).

Figure 13:
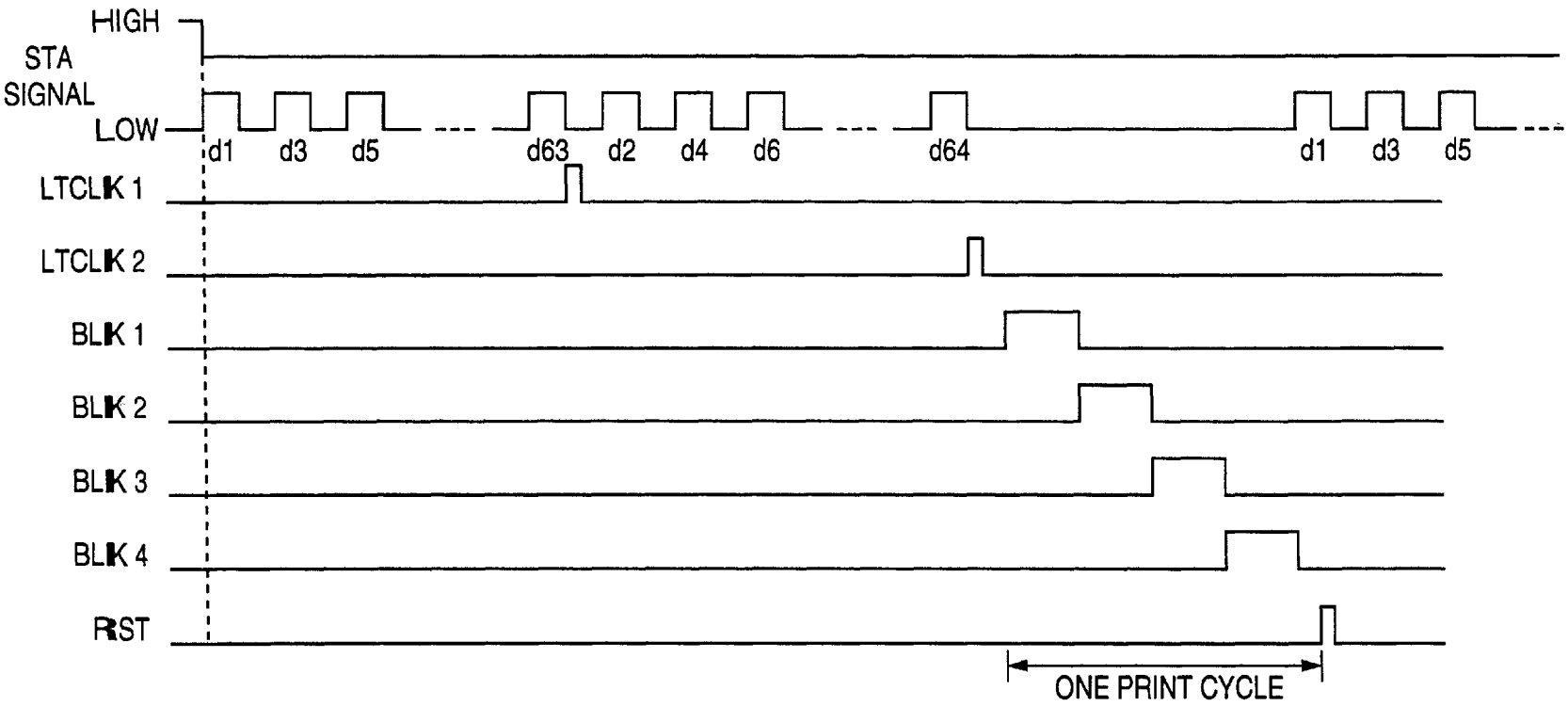
FIG. 13 is a timing chart of various signals in a case where printing is performed at print density 720 dpi.

As shown in FIG. 13, among 64 bits of image data corresponding to the print width of the printhead IJH, the printer first transmits image data having odd-number bits (b1, b3, . . . , b63) to the 32-bit shift register 102 of the printhead IJH, and transmits the latch clock (LTCLK1) to latch the odd-number data in the latch circuit 103. The printer then transmits the image data having even-number bits (b2, b4, . . . , b64) to the 32-bit shift register 103 of the printhead IJH, and supplies the latch clock (LTCLK2) to latch the even-number data in the latch circuit 104. As a result, 64-bit data is stored in the latch circuits 103 and 104.

Next, as the printer sequentially transmits the block-selecting signals (BLK1 to BLK4), heaters corresponding to the odd-number bit data which has been latched are driven and printing is performed. As described above, the block-selecting signals (BLK1 to BLK4) provide each heater with the chance to be driven once, and heaters corresponding to "ON" image data are driven. The printer then transmits a reset signal (RST) to the printhead IJH, resetting the 32-bit shift is register 102, and latch circuits 103 and 104, then the same operation is repeated.

Figure 12C:
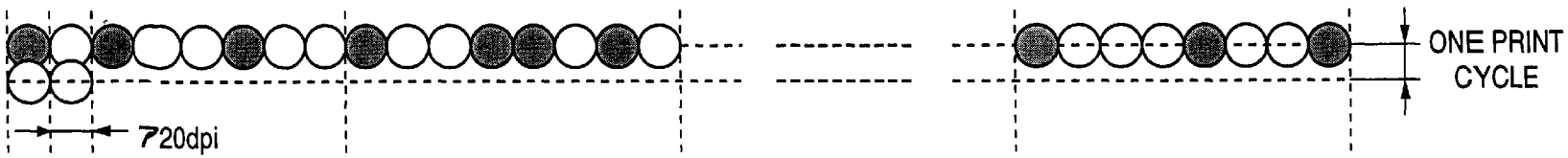

The dots printed in the foregoing manner are shown in FIG. 12C.

As set forth above, when printing is performed at print density of 720 dpi, the 32-bit shift register 102 is utilized twice, so that the image data is held in the unit of 32 bits respectively by the latches 103 and 104. Accordingly, printing in high density is realized.

According to the above-described embodiment, in the case where the printhead IJH capable of printing at print density of 720 dpi is installed in the conventional-type printer (360 dpi), print data transmitted from the printer is used twice in the print-width direction of the printhead, and twice in the moving direction of the printhead, so that four print dots having print density of 720 dpi substantially forms one print dot having print density of 360 dpi. Meanwhile, in the case where the printhead IJH is installed in the new-type printer (720 dpi), the shift register is used twice to latch image data having the capacity twice as large as that of the shift register, thereby realizing printing in high density.

Although the present embodiment describes the printhead having print density of 720 dpi and the printer capable of printing at 720 dpi as a new type, and the printhead having print density of 360 dpi and a printer capable of printing at 360 dpi as the conventional type, the present invention is not limited to this. Print density other than those described above, e.g. 300 dpi, may be the case for the conventional type, and e.g. 600 dpi, may be the case for the new type. In addition, the number of heaters incorporated in the printhead is not limited to the above-described embodiment. In other words, the printer may have any configuration so long as heaters in a printhead is driven plural times in one print cycle of the printhead, and printing operation is executed by utilizing the same data for plural times.

In the above description, the ratio of ink discharge amount per one nozzle, between the printhead IJH and the printhead shown in FIGS. 14 and 15 which is used as a typical conventional example, is 1:4. However, the ratio may vary. Taking image quality and high-density printing into consideration, it is empirically known that the ink discharge amount per one nozzle needs to be less than half the amount of ink discharge per dot of the conventional printhead; otherwise, the capability of printing in high density would be worthless because of the sizes of dots and the like.

Furthermore, the above description has been made, utilizing the logical circuit incorporated along with the heaters in the substrate of the printhead. However, an IC may be provided in the printhead separately from the substrate integrating the heaters. However, since this must be manufactured as separate parts, the type integrated with the heaters is preferable for the purpose of cost reduction.

Moreover, the above embodiments describe the case where the substrate of the printhead is employed in the printhead adopting ink-jet printing method. However the present invention is not limited to this, and may be applied to other printing methods, e.g. a substrate for a thermal head which performs printing by thermal printing method.

Each of the embodiments described above has exemplified a printer, which comprises means (e.g., an electrothermal transducer, laser beam generator, and the like) for generating heat energy as energy utilized upon execution of ink discharge, and causes a change in state of an ink by the heat energy, among the ink-jet printers. According to this ink-jet printer and printing method, a high-density, high-precision printing operation can be attained.

As the typical arrangement and principle of the ink-jet printing system, one practiced by use of the basic principle disclosed in, for example, U.S. Pat. Nos. 4,723,129 and 4,740,796 is preferable. The above system is applicable to either one of so-called an on-demand type and a continuous type. Particularly, in the case of the on-demand type, the system is effective because, by applying at least one driving signal, which corresponds to printing information and gives a rapid temperature rise exceeding film boiling, to each of electrothermal transducers arranged in correspondence with a sheet or liquid channels holding a liquid (ink), heat energy is generated by the electrothermal transducer to effect film boiling on the heat acting surface of the printhead, and consequently, a bubble can be formed in the liquid (ink) in one-to-one correspondence with the driving signal. By discharging the liquid (ink) through a discharge opening by growth and shrinkage of the bubble, at least one droplet is formed. If the driving signal is applied as a pulse signal, the growth and shrinkage of the bubble can be attained instantly-and adequately to achieve discharge of the liquid (ink) with the particularly high response characteristics.

As the pulse driving signal, signals disclosed in U.S. Pat. Nos. 4,463,359 and 4,345,262 are suitable. Note that further excellent printing can be performed by using the conditions described in U.S. Pat. No. 4,313,124 of the invention which relates to the temperature rise rate of the heat acting surface.

As an arrangement of the printhead, in addition to the arrangement as a combination of discharge nozzles, liquid channels, and electrothermal transducers (linear liquid channels or right angle liquid channels) as disclosed in the above specifications, the arrangement using U.S. Pat. Nos. 4,558,333 and 4,459,600, which disclose the arrangement having a heat acting portion arranged in a flexed region is also included in the present invention.

Furthermore, as a full line type printhead having a length corresponding to the width of a maximum printing medium which can be printed by the printer, either the arrangement which satisfies the full-line length by combining a plurality of printheads as disclosed in the above specification or the arrangement as a single printhead obtained by forming printheads integrally can be used.

In addition, not only an exchangeable chip type printhead, as described in the above embodiment, which can be electrically connected to the apparatus main unit and can receive an ink from the apparatus main unit upon being mounted on the apparatus main unit but also a cartridge type printhead in which an ink tank is integrally arranged on the printhead itself can be applicable to the present invention.

It is preferable to add recovery means for the printhead, preliminary auxiliary means, and the like provided as an arrangement of the printer of the present invention since the printing operation can be further stabilized. Examples of such means include, for the printhead, capping means, cleaning means, pressurization or suction means, and preliminary heating means using electrothermal transducers, another heating element, or a combination thereof. It is also effective for stable printing to provide a preliminary discharge mode which performs discharge independently of printing.

Furthermore, as a printing mode of the printer, not only a printing mode using only a primary color such as black or the like, but also at least one of a multi-color mode using a plurality of different colors or a full-color mode achieved by color mixing can be implemented in the printer either by using an integrated printhead or by combining a plurality of printheads.

Moreover, in each of the above-mentioned embodiments of the present invention, it is assumed that the ink is a liquid. Alternatively, the present invention may employ an ink which is solid at room temperature or less and softens or liquefies at room temperature, or an ink which liquefies upon application of a use printing signal, since it is a general practice to perform temperature control of the ink itself within a range from 30° C. to 70° C. in the ink-jet system, so that the ink viscosity can fall within a stable discharge range.

In addition, in order to prevent a temperature rise caused by heat energy by positively utilizing it as energy for causing a change in state of the ink from a solid state to a liquid state, or to prevent evaporation of the ink, an ink which is solid in a non-use state and liquefies upon heating may be used. In any case, an ink which liquefies upon application of heat energy according to a printing signal and is discharged in a liquid state, an ink which begins to solidify when it reaches a printing medium, or the like, is applicable to the present invention. In the present invention, the above-mentioned film boiling system is most effective for the above-mentioned inks.

In addition, the ink-jet printer of the present invention may be used in the form of a copying machine combined with a reader, and the like, or a facsimile apparatus having a transmission/reception function in addition to an image output terminal of an information processing equipment such as a computer.

The present invention can be applied to a system constituted by a plurality of devices (e.g., host computer, interface, reader, printer) or to an apparatus comprising a single device (e.g., copy machine, facsimile).

As many apparently widely different embodiments of the present invention can be made without departing from the spirit and scope thereof, it is to be understood that the invention is not limited to the specific embodiments thereof except as defined in the appended claims.

What is claimed is:

1. A printhead, which can be incorporated into plural types of printers, for performing printing by discharging ink, comprising:

determining means for determining a type of a printer in which said printhead is installed, said determining means having a determination result; and selecting means for selecting a driving method according to the printer, on the basis of the determination result of said determining means.

2. The printhead according to claim 1, wherein said determining means comprises a determination terminal to which the printer inputs a predetermined signal to determine a type of the printer.

3. The printhead according to claim 2, wherein in said determination terminal, a high level signal or a low level signal is inputted from the printer.

4. The printhead according to claim 1, wherein said printhead is a printhead for discharging ink by utilizing heat energy, and includes heat energy generators for generating heat energy applied to the ink.

5. The printhead according to claim 4, wherein each of a plurality of ink channels for discharging ink comprises a first heat energy generator for discharging a large ink droplet and a second heat energy generator for discharging a small ink droplet.

6. The printhead according to claim 5, wherein said selecting means selects, in a case where no signal is inputted to the determination terminal, the driving method which is a method of simultaneously driving the first and second heat energy generators.

7. The printhead according to claim 5, further comprising a first-drive-signal input terminal for inputting a first drive signal which drives the first heat energy generator and a second-drive-signal input terminal for inputting a second drive signal which drives the second heat energy generator, wherein the first and second drive signals drive the respective heat energy generators independent of each other.

8. The printhead according to claim 4, wherein a plurality of the heat energy generators are provided in each of liquid channels for discharging ink.

9. The printhead according to claim 8, wherein the plurality of the heat energy generators in each of the liquid channels can be driven independent of each other, and further comprising a plurality of latch circuits, corresponding to the plurality of the heat energy generators, for supplying print data to the plurality of the heat energy generators, respectively.

10. The printhead according to claim 9, wherein, in a case where the plurality of heat energy generators are concurrently driven, the identical data is supplied to each of the plurality of latch circuits.

11. A recording apparatus using a printhead claimed in claim 1, comprising output means for outputting a signal to said determining means.

12. A printhead cartridge comprising the printhead claimed in claim 1 and an ink tank containing ink that is supplied to said printhead.

13. The printhead cartridge according to claim 12, wherein the printhead and the ink tank are integrated.

14. The printhead cartridge according to claim 12, wherein the printhead and the ink tank are separable.

15. A printing method comprising the steps of:

determining in a printhead, a type of a printer incorporating said printhead;

selecting a driving method according to the printer, on the basis of the determination result in said determining step; and printing by driving the printhead in accordance with the driving method selected in said selecting step.

16. A printhead compatible with plural types of printers whose print resolution are different, comprising:

determining means for determining which type of the printers is used, the determining means having a determination result; and drive control means for controlling drivers, on the basis of the determination result of said determining means, such that printing is performed in accordance with a print resolution of the printer incorporating said printhead.

17. The printhead according to claim 16, further comprising:

N (positive integer) printing elements;

N driving circuits for supplying power and driving said N printing elements;

M (positive integer) latch circuits for latching N/M bits of image data;

a shift register for storing the N/M bits of image data;

L (positive integer) block-selecting-signal input terminals for inputting L block-selecting signals so as to divide the N printing elements into L blocks and drive the L blocks respectively;

a print-density-selecting signal terminal for inputting a print-density selecting signal which selectively instructs printing in a first print density or in a second print density, which is M times as the first print density; and a control circuit for controlling latch operation for the M latch circuits in accordance with the print-density selecting signal, wherein each of the N driving circuits is driven for M times in one cycle of the L block-selecting signals.

18. The printhead according to claim 17, wherein the M is an integer equal to or larger than 2.

19. The printhead according to claim 18, wherein a ratio between the first and second print density is 1:2.

20. The printhead according to claim 19, wherein said N printing elements are arranged such that printing can be performed in the second print density.

21. The printhead according to claim 16, wherein a plurality of the heat energy generators are provided in each of liquid channels for discharging ink.

22. The printhead according to claim 21, wherein the plurality of the heat energy generators in each of the liquid channels can be driven independent of each other, and further comprising a plurality of latch circuits, corresponding to the plurality of the heat energy generators, for supplying print data to the plurality of the heat energy generators, respectively.

23. The printhead according to claim 22, wherein, in a case where the plurality of heat energy generators are concurrently driven, the identical data is supplied to each of the plurality of latch circuits.

24. The printhead according to claim 17, wherein in a case where printing is performed in the first print density, said control circuit controls the M latch circuits such that the same data is latched in the M latch circuits.

25. The printhead according to claim 17, wherein in a case where printing is performed in the first print density, a plurality of print dots printed in the second print density substantially express one print dot printed in the first print density.

26. The printhead according to claim 17, wherein said control circuit automatically determines a print density printable by the printer incorporating said printhead in accordance with the print-density selecting signal.

27. The printhead according to claim 26, wherein in a case where said printhead is installed in a printer capable of printing in the first print density, said print-density-selecting signal terminal is not connected to the printer, thus being electrically open.

28. The printhead according to claim 27, wherein said control circuit pulls up or pulls down said print-density-selecting signal terminal, and even in a case where said print-density-selecting signal terminal is electrically open, said control circuit can input a print-density selecting signal corresponding to the pull-up or pull-down operation.

29. The printhead according to claim 17, wherein said N printing elements, said N driving circuits, said M latch circuits, said shift register, said L block-selecting-signal input terminals, and said print-density-selecting signal terminal are integrated in one circuit substrate.

30. The printhead according claim 16, wherein said printhead is an ink-jet printhead which performs printing by discharging ink.

31. The printhead according to claim 30, wherein said printhead is a printhead for discharging ink by utilizing heat energy, and includes heat energy generators for generating heat energy applied to the ink.

32. The printhead according to claim 30, wherein an amount of ink discharged by single discharging operation of one of the printing elements is about 20 ng.

33. A recording apparatus using the printhead claimed in claim 17, comprising:

transmit means for transmitting the print-density selecting signal to said print-density-selecting signal terminal;

transfer means for transferring image data in a unit of N/M bits to said shift register for M times; and latch control means for controlling the latch operation such that a latch signal is transferred each time said transfer means transfers the N/M bits of image data, and that transfer operation for M times realizes latching of the N bits of image data in the M latch circuits.

34. The recording apparatus according to claim 33, wherein said printer performs printing in the second print density.

35. A printhead cartridge comprising the printhead claimed in claim 16 and an ink tank containing ink that is supplied to said printhead.

36. The printhead cartridge according to claim 35, wherein the printhead and the ink tank are integrated.

37. The printhead cartridge according to claim 35, wherein the printhead and the ink tank are separable.

38. A print control method utilizing a printhead compatible with plural types of printers whose print resolution are different, comprising the steps of:

determining which type of the printers is used, based upon a connection between the printhead and the printer incorporating the printhead, to obtain a determination result; and controlling driving of drivers on the basis of the determination result in said determining step, such that printing is performed in accordance with a print resolution of the printer incorporating said printhead.

39. A printhead substrate incorporated in a printhead that can be incorporated into plural types of printers, said substrate comprising:

determining means for determining a type of a printer incorporating said printhead, said determining means having a determining result; and selecting means for selecting a driving method according to the printer, on the basis of the determination result of said determining means.

* * * * *

UNITED STATES PATENT AND TRADEMARK OFFICE

CERTIFICATE OF CORRECTION

PATENT NO. : 6,224,184 B1
DATED : May 1, 2001
INVENTOR(S) : Yoshiyuki Imanaka et al.

It is certified that error appears in the above-identified patent and that said Letters Patent is hereby corrected as shown below:

Title page,
Item [56] References Cited, under FOREIGN PATENT DOCUMENTS:
"2843064 4/1979 (JP)." should read -- 2843064 4/1979 (DE). --.
Item [57] ABSTRACT, line 9, "to in the" should read -- to the --.

Column 1,
Line 18, "interests have" should read -- interest has --.

Column 4,
Line 49, "L" should be deleted.

Column 5,
Line 7, manufacturers" shoud read -- manufacturer --.

Column 9,
Line 66, "above described" should read -- above-described --.

Column 10,
Line 49, "independently" should read -- independently. --.

Column 15,
Line 41, "However" should read -- However, --.

Signed and Sealed this

Second Day of April, 2002

*Attest:*

*Attesting Officer*

JAMES E. ROGAN
*Director of the United States Patent and Trademark Office*